US010588467B2

(12) United States Patent
Yang et al.

(10) Patent No.: US 10,588,467 B2
(45) **Date of Patent: *Mar. 17, 2020**

(54) FOAMING SOAP DISPENSERS

(71) Applicant: simplehuman, LLC, Torrance, CA (US)

(72) Inventors: Frank Yang, Rancho Palos Verdes, CA (US); David Wolbert, Manhanttan Beach, CA (US); Kenneth Yen, Redondo Beach, CA (US); Guy Cohen, Marina Del Rey, CA (US); Hon-Lun Chen, Irvine, CA (US); Nasser Pirshafiey, Thousand Oaks, CA (US); Joseph Sandor, Newport Beach, CA (US)

(73) Assignee: simplehuman, LLC, Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/110,220

(22) Filed: Aug. 23, 2018

(65) Prior Publication Data

US 2018/0360276 A1 Dec. 20, 2018

Related U.S. Application Data

(63) Continuation of application No. 15/060,241, filed on Mar. 3, 2016, now Pat. No. 10,076,216.

(Continued)

(51) Int. Cl.

*A47K 5/14* (2006.01)
*A47K 5/12* (2006.01)

(Continued)

(52) U.S. Cl.

CPC ..... *A47K 5/14* (2013.01); *A47K 5/1208* (2013.01); *A47K 5/16* (2013.01); *B05B 7/005* (2013.01);

(Continued)

(58) Field of Classification Search

CPC ..... A47K 5/14; A47K 5/1208; A47K 5/16; A47K 5/1215; B05B 7/005;

(Continued)

(56) References Cited

U.S. PATENT DOCUMENTS 2,017,867 A 10/1935 Nantz
2,106,043 A 1/1938 Urquhart et al.

(Continued)

FOREIGN PATENT DOCUMENTS

CN 1285899 A 2/2001
CN 101606828 A 12/2009

(Continued)

OTHER PUBLICATIONS simplehuman® Rechargeable Sensor Soap Dispenser, Item No. 201881, https://www.sharperimage.com/si/view/product/Rechargeable-Sensor-Soap-Dispenser/201881?trail, Sep. 3, 2013, in 3 pages.

(Continued)

*Primary Examiner* — Frederick C Nicolas

(74) *Attorney, Agent, or Firm* — Knobbe, Martens, Olson & Bear, LLP

(57) ABSTRACT

Various dispensing devices, such as foaming soap pumps, are disclosed. The soap pump can include a fluid storage unit and a fluid handling unit. The fluid storage unit can include a reservoir that is configured to hold a quantity of product, such as liquid soap. The fluid handling unit can include a pumping assembly and dispensing assembly. The soap pump can be configured to withdraw liquid soap from the reservoir, convert the liquid soap to foamed soap, and dispense the foamed soap from the discharge assembly.

30 Claims, 30 Drawing Sheets

Related U.S. Application Data

(60) Provisional application No. 62/129,684, filed on Mar. 6, 2015.

(51) Int. Cl.

| | |
|---|---|
| ***B05B 11/00*** | (2006.01) |
| ***B05B 7/00*** | (2006.01) |
| ***A47K 5/16*** | (2006.01) |
| ***F04B 43/02*** | (2006.01) |
| ***F04B 43/04*** | (2006.01) |
| ***F04B 43/00*** | (2006.01) |
| ***F04B 13/02*** | (2006.01) |
| ***F04B 23/02*** | (2006.01) |

(52) U.S. Cl.
CPC ..... *B05B 11/3047* (2013.01); *B05B 11/3087* (2013.01); *F04B 13/02* (2013.01); *F04B 23/028* (2013.01); *F04B 43/0063* (2013.01); *F04B 43/026* (2013.01); *F04B 43/04* (2013.01); *A47K 5/1215* (2013.01)

(58) Field of Classification Search
CPC .. B05B 11/3047; B05B 11/3087; F04B 13/02; F04B 23/028; F04B 43/0063; F04B 43/026; F04B 43/04
See application file for complete search history.

(56) References Cited

U.S. PATENT DOCUMENTS

| | | | |
|---|---|---|---|
| 2,651,545 | A | 9/1953 | Shotton |
| 2,697,446 | A | 12/1954 | Harrington |
| 2,772,817 | A | 12/1956 | Jauch |
| 3,023,922 | A | 3/1962 | Arrington et al. |
| 3,149,754 | A | 9/1964 | Kogan et al. |
| 3,220,954 | A | 11/1965 | Malbe |
| 3,531,021 | A | 9/1970 | Bassett |
| 3,631,736 | A | 1/1972 | Saari |
| 3,701,482 | A | 10/1972 | Sachnik |
| 4,046,289 | A | 9/1977 | Teranishi |
| 4,056,050 | A | 11/1977 | Brown |
| 4,113,147 | A | 9/1978 | Frazier et al. |
| 4,202,387 | A | 5/1980 | Upton |
| 4,217,993 | A | 8/1980 | Jess et al. |
| 4,457,455 | A | 7/1984 | Meshberg |
| 4,498,843 | A | 2/1985 | Schneider et al. |
| 4,524,805 | A | 6/1985 | Hoffman |
| 4,693,854 | A | 9/1987 | Yau |
| 4,722,372 | A | 2/1988 | Hoffman et al. |
| 4,915,347 | A | 4/1990 | Iqbal et al. |
| 4,921,131 | A | 5/1990 | Binderbauer et al. |
| 4,938,384 | A | 7/1990 | Pilolla |
| 4,946,070 | A | 8/1990 | Albert et al. |
| 4,967,935 | A | 11/1990 | Celest |
| 5,028,328 | A | 7/1991 | Long |
| 5,082,150 | A | 1/1992 | Steiner et al. |
| 5,105,992 | A | 4/1992 | Fender et al. |
| 5,169,040 | A | 12/1992 | Wiley |
| 5,186,360 | A | 2/1993 | Mease et al. |
| 5,199,118 | A | 4/1993 | Cole et al. |
| 5,255,822 | A | 10/1993 | Mease et al. |
| 5,271,528 | A | 12/1993 | Chien |
| 5,305,916 | A | 4/1994 | Suzuki et al. |
| 5,449,280 | A | 9/1995 | Maki et al. |
| 5,466,131 | A | 11/1995 | Altham et al. |
| 5,472,719 | A | 12/1995 | Favre |
| 5,477,984 | A | 12/1995 | Sayama et al. |
| 5,509,578 | A | 4/1996 | Livingstone |
| 5,632,414 | A | 5/1997 | Merriweather, Jr. |
| 5,771,925 | A | 6/1998 | Lewandowski |
| 5,823,390 | A | 10/1998 | Muderlak et al. |
| 5,829,636 | A | 11/1998 | Vuong et al. |
| 5,836,482 | A | 11/1998 | Ophardt et al. |
| 5,960,991 | A | 10/1999 | Ophardt |
| D416,154 | S | 11/1999 | Diehl |
| 5,988,451 | A | 11/1999 | Hanna |
| 6,021,705 | A | 2/2000 | Dijs |
| 6,021,960 | A | 2/2000 | Kehat |
| 6,036,056 | A | 3/2000 | Lee et al. |
| 6,048,183 | A | 4/2000 | Meza |
| D426,093 | S | 6/2000 | Cayouette |
| D426,413 | S | 6/2000 | Kreitemier et al. |
| 6,126,290 | A | 10/2000 | Veigel |
| D433,944 | S | 11/2000 | Bernard |
| 6,142,340 | A | 11/2000 | Watanabe et al. |
| D438,041 | S | 2/2001 | Huang |
| 6,209,752 | B1 | 4/2001 | Mitchell et al. |
| RE37,173 | E | 5/2001 | Jefferson, Jr. et al. |
| 6,269,735 | B1 | 8/2001 | Rolfes |
| 6,279,460 | B1 | 8/2001 | Pope |
| 6,279,777 | B1 | 8/2001 | Goodin et al. |
| 6,311,868 | B1 | 11/2001 | Krietemeier et al. |
| 6,325,604 | B1 | 12/2001 | Du |
| 6,375,038 | B1 | 4/2002 | Daansen et al. |
| 6,390,329 | B1 | 5/2002 | Maddox |
| 6,443,328 | B1 | 9/2002 | Fehl et al. |
| 6,444,956 | B1 | 9/2002 | Witcher et al. |
| D471,047 | S | 3/2003 | Gordon et al. |
| 6,557,584 | B1 | 5/2003 | Lucas et al. |
| 6,594,105 | B1 | 7/2003 | Brittner |
| D477,956 | S | 8/2003 | Grisdale et al. |
| 6,619,938 | B2 | 9/2003 | Woodruff |
| D483,974 | S | 12/2003 | Reed |
| D484,573 | S | 12/2003 | Haug et al. |
| D486,335 | S | 2/2004 | Sonneman |
| 6,698,616 | B2 | 3/2004 | Hidle et al. |
| 6,722,265 | B2 | 4/2004 | Priley |
| D490,262 | S | 5/2004 | Graves et al. |
| 6,748,850 | B1 | 6/2004 | Kraan |
| 6,777,007 | B2 | 8/2004 | Cai |
| 6,805,042 | B2 | 10/2004 | Mordini et al. |
| 6,824,369 | B2 | 11/2004 | Raymond |
| D499,295 | S | 12/2004 | Grisdale et al. |
| 6,832,542 | B2 | 12/2004 | Hu et al. |
| 6,892,899 | B2 | 5/2005 | Minard et al. |
| 6,929,150 | B2 | 8/2005 | Muderlak et al. |
| 6,971,549 | B2 | 12/2005 | Leifheit et al. |
| 7,008,073 | B2 | 3/2006 | Stuhlmacher |
| D530,954 | S | 10/2006 | Snell |
| D531,440 | S | 11/2006 | Lo |
| D531,441 | S | 11/2006 | Soriano |
| D531,845 | S | 11/2006 | Christianson |
| D534,753 | S | 1/2007 | Christianson |
| 7,178,746 | B2 | 2/2007 | Gross |
| 7,213,593 | B2 | 5/2007 | Hochrainer |
| D554,412 | S | 11/2007 | Yang et al. |
| 7,296,765 | B2 | 11/2007 | Rodrian |
| D560,942 | S | 2/2008 | Hanna |
| D564,273 | S | 3/2008 | Yang et al. |
| 7,337,635 | B2 | 3/2008 | Cerruti et al. |
| D565,878 | S | 4/2008 | Krus |
| 7,354,015 | B2 | 4/2008 | Byrd et al. |
| D581,193 | S | 11/2008 | Ghiorghie |
| D582,187 | S | 12/2008 | Yang et al. |
| 7,479,000 | B2 | 1/2009 | Klassen |
| D593,784 | S | 6/2009 | Chan |
| 7,540,397 | B2 | 6/2009 | Muderlak et al. |
| D604,544 | S | 11/2009 | Daams |
| 7,637,893 | B2 | 12/2009 | Christensen et al. |
| D608,578 | S | 1/2010 | Yang et al. |
| D622,991 | S | 9/2010 | MacDonald et al. |
| D626,365 | S | 11/2010 | Yang et al. |
| D644,523 | S | 9/2011 | Howell et al. |
| D644,529 | S | 9/2011 | Padain et al. |
| D644,530 | S | 9/2011 | Padain et al. |
| D644,531 | S | 9/2011 | Padain et al. |
| 8,087,543 | B2 | 1/2012 | Yang et al. |
| 8,096,445 | B2 | 1/2012 | Yang et al. |
| 8,109,301 | B1 | 2/2012 | Denise |
| 8,109,411 | B2 | 2/2012 | Yang et al. |
| 8,152,027 | B1 | 4/2012 | Baker |
| D658,915 | S | 5/2012 | Fernandes et al. |
| D659,452 | S | 5/2012 | Yang et al. |

(56) References Cited

U.S. PATENT DOCUMENTS

| | | | |
|---|---|---|---|
| D659,454 | S | 5/2012 | Fritz et al. |
| D660,061 | S | 5/2012 | Fernandes et al. |
| D661,531 | S | 6/2012 | Tompkin |
| D661,933 | S | 6/2012 | Delgigante et al. |
| D663,983 | S | 7/2012 | Yang et al. |
| D664,387 | S | 7/2012 | Kennedy |
| D672,177 | S | 12/2012 | Zeng |
| D674,636 | S | 1/2013 | Yang et al. |
| 8,360,285 | B2 | 1/2013 | Grbesic |
| D676,116 | S | 2/2013 | Judd |
| D682,589 | S | 5/2013 | Cheng |
| D688,488 | S | 8/2013 | Wang |
| D689,299 | S | 9/2013 | Kassem Llano et al. |
| D690,129 | S | 9/2013 | Clough et al. |
| D690,130 | S | 9/2013 | Clough et al. |
| D690,131 | S | 9/2013 | Clough et al. |
| D690,530 | S | 10/2013 | Clough et al. |
| 8,550,378 | B2 | 10/2013 | Mazooji et al. |
| D693,597 | S | 11/2013 | Yang et al. |
| D699,047 | S | 2/2014 | Lissoni |
| D699,475 | S | 2/2014 | Yang et al. |
| D699,574 | S | 2/2014 | Cox et al. |
| 8,662,356 | B2 | 3/2014 | Padain et al. |
| 8,678,244 | B2 | 3/2014 | Yang et al. |
| D706,549 | S | 6/2014 | Cho |
| D717,066 | S | 11/2014 | Deacon |
| D721,279 | S | 1/2015 | Van Handel et al. |
| D727,653 | S | 4/2015 | Bjerre-Poulsen et al. |
| D731,203 | S | 6/2015 | Watson et al. |
| D731,204 | S | 6/2015 | Watson et al. |
| D732,308 | S | 6/2015 | Enga et al. |
| D746,136 | S | 12/2015 | Liu |
| 9,265,383 | B2 | 2/2016 | Yang et al. |
| 9,375,741 | B2 | 6/2016 | Turner |
| D770,798 | S | 11/2016 | Yang et al. |
| D773,847 | S | 12/2016 | Judd |
| D773,848 | S | 12/2016 | Yang et al. |
| D785,970 | S | 5/2017 | Yang et al. |
| D786,579 | S | 5/2017 | Beck et al. |
| 9,763,546 | B2 | 9/2017 | Yang et al. |
| D818,741 | S | 5/2018 | Yang et al. |
| 10,076,216 | B2 | 9/2018 | Yang et al. |
| D829,465 | S | 10/2018 | Yang et al. |
| 2002/0179643 | A1 | 12/2002 | Knight et al. |
| 2002/0185002 | A1 | 12/2002 | Herrmann |
| 2003/0068242 | A1 | 4/2003 | Yamakawa |
| 2004/0032749 | A1 | 2/2004 | Schindler et al. |
| 2004/0050875 | A1 | 3/2004 | Kobayashi |
| 2004/0103792 | A1 | 6/2004 | Cirigliano et al. |
| 2004/0134924 | A1 | 7/2004 | Hansen et al. |
| 2004/0226962 | A1 | 11/2004 | Mazursky et al. |
| 2005/0006407 | A1 | 1/2005 | Lawson et al. |
| 2005/0139612 | A1 | 6/2005 | Matthews et al. |
| 2006/0067546 | A1 | 3/2006 | Lewis et al. |
| 2006/0173576 | A1 | 8/2006 | Goerg et al. |
| 2006/0243740 | A1 | 11/2006 | Reynolds et al. |
| 2007/0000941 | A1 | 1/2007 | Hadden et al. |
| 2007/0138202 | A1 | 6/2007 | Evers |
| 2007/0138208 | A1 | 6/2007 | Scholz et al. |
| 2007/0158359 | A1 | 7/2007 | Rodrian |
| 2007/0274853 | A1 | 11/2007 | Merendeiro et al. |
| 2008/0149669 | A1 | 6/2008 | Nicholson et al. |
| 2008/0277411 | A1 | 11/2008 | Beland et al. |
| 2008/0277421 | A1 | 11/2008 | Zlatic et al. |
| 2008/0283556 | A1 | 11/2008 | Snodgrass |
| 2009/0026225 | A1 | 1/2009 | Lickstein |
| 2009/0088836 | A1 | 4/2009 | Bishop et al. |
| 2009/0140004 | A1 | 6/2009 | Scorgie |
| 2009/0184134 | A1 | 7/2009 | Ciavarella et al. |
| 2009/0200340 | A1 | 8/2009 | Ophardt et al. |
| 2010/0031982 | A1 | 2/2010 | Hornsby et al. |
| 2010/0051642 | A1 | 3/2010 | Wong et al. |
| 2010/0282772 | A1 | 11/2010 | Ionidis |
| 2011/0017769 | A1 | 1/2011 | Ophardt |
| 2011/0114669 | A1 | 5/2011 | Yang et al. |
| 2012/0111895 | A1 | 5/2012 | Fitzpatrick et al. |
| 2012/0138632 | A1 | 6/2012 | Li et al. |
| 2012/0138637 | A1 | 6/2012 | Ciavarella et al. |
| 2012/0285992 | A1 | 11/2012 | Ciavarella et al. |
| 2012/0318820 | A1 | 12/2012 | Amsel et al. |
| 2013/0119083 | A1 | 5/2013 | Ophardt et al. |
| 2013/0140323 | A1 | 6/2013 | Yun et al. |
| 2013/0200109 | A1 | 8/2013 | Yang et al. |
| 2013/0214011 | A1 | 8/2013 | Vandekerchkhove et al. |
| 2014/0103072 | A1 | 4/2014 | Pelfrey |
| 2014/0137982 | A1 | 5/2014 | Nicholls et al. |
| 2015/0265106 | A1 | 9/2015 | Rospierski |
| 2017/0015541 | A1 | 1/2017 | Vulpitta et al. |
| 2018/0220850 | A1 | 8/2018 | Yang et al. |
| 2018/0263432 | A1 | 9/2018 | Yang et al. |

FOREIGN PATENT DOCUMENTS

| | | | |
|---|---|---|---|
| CN | 102058336 | A | 5/2011 |
| DE | 3718967 | C2 | 5/1994 |
| EP | 0455431 | A1 | 11/1991 |
| EP | 0493865 | A1 | 7/1992 |
| EP | 2135538 | A1 | 12/2009 |
| EP | 2322068 | A2 | 5/2011 |
| EP | 2546523 | A2 | 1/2013 |
| EP | 2738387 | A1 | 6/2014 |
| JP | H07-23876 | | 1/1995 |
| JP | D1117308 | | 6/2001 |
| JP | D1266683 | | 2/2006 |
| JP | 2013-133754 | A | 7/2013 |
| KR | 3002845520000 | | 11/2001 |
| WO | WO 2008/095187 | | 8/2008 |
| WO | WO 2008/103300 | A2 | 8/2008 |
| WO | WO 2012/122056 | | 9/2012 |
| WO | WO 2012/154642 | A1 | 11/2012 |
| WO | WO 2013/119642 | A1 | 8/2013 |
| WO | WO 2013/119874 | A1 | 8/2013 |

OTHER PUBLICATIONS

Manring et al., "The Theoretical Flow Ripple of an External Gear Pump," Transactions of the ASME, vol. 125, Sep. 2003, pp. 396-404.

The Sharper Image Soap Genie SI335, Mar. 2006, in 8 pages.

Extended Search Report in corresponding European Patent Application No. 16158630.0, dated Aug. 3, 2016, in 10 pages.

Office Action in corresponding Chinese Patent Application No. 201610127661.X, dated Nov. 1, 2019, in 10 pages.

Observations by Third Party in corresponding European Patent Application No. 16158630.0, Dec. 13, 2019, in 32 pages.

Office Action in corresponding European Patent Application No. 16158630.0, dated Jan. 20, 2020, in 6 pages.

FOAMING SOAP DISPENSERS

CROSS-REFERENCE

This application is a continuation of U.S. patent application Ser. No. 15/060,241, filed Mar. 3, 2016, which claims the priority benefit under 35 U.S.C. § 119 of U.S. Provisional Application No. 62/129,684, filed Mar. 6, 2015, the entirety of each of the aforementioned applications is hereby incorporated by reference. This application also incorporates by reference the entirety of U.S. Design patent application Ser. No. 29/518,584, filed Feb. 25, 2015.

BACKGROUND

Field

This disclosure relates to dispensing devices, such as soap pumps that are configured to dispense foamed soap.

Description of Certain Related Art

Certain dispensing devices are configured to store and dispense a liquid soap to a user. This can require that the user manually foam the soap after the dispensation, which can be time consuming and/or inconvenient. Improper manual foaming of the soap can be wasteful and can reduce the cleaning efficacy of the soap.

SUMMARY

Various dispensing devices, such as foaming soap pumps, are disclosed. The soap pump can include a fluid storage unit, which can include a reservoir configured to hold a quantity of product, such as liquid soap. The soap pump can include a fluid handling unit, which can include a pumping assembly and dispensing assembly. The soap pump can be configured to withdraw liquid soap from the reservoir, convert the liquid soap to foamed soap, and dispense the foamed soap from the discharge assembly.

Some embodiments disclosed herein include a foaming soap pump. The foaming soap pump can comprise a fluid storage unit. The fluid storage unit can comprise a reservoir. The reservoir can be configured to store liquid soap.

The foaming soap pump can comprise a fluid handling unit. The fluid handling unit can comprise a pumping assembly. The pumping assembly can be configured to draw liquid soap from the reservoir. The pumping assembly can comprise a pumping unit. The pumping unit can comprise a compartment. The compartment can have a resilient member. The resilient member can be actuatable between a first state and a second state. The volume of the compartment can be greater in the first state than in the second state. The pumping assembly can comprise a motor. The motor can be configured to drive an actuation member. The actuation member can be configured to engage and disengage with the resilient member of the pumping unit. The pumping assembly can be configured such that when the actuation member disengages from the resilient member, the resilient member moves from the second state to the first state. In some embodiments, the movement can thereby increase the volume in the compartment and draw liquid soap into the compartment. In some embodiments, when the actuation member engages the resilient member, the resilient member can move from the first state to the second state. The movement can decrease the volume in the compartment and expel liquid soap from the compartment.

The fluid handling unit can comprise a dispensing assembly. The dispensing assembly can be configured to receive a flow of soap from the pumping assembly. The dispensing assembly can comprise a foaming unit. The foaming unit can be configured to convert the soap into foamed soap. The dispensing assembly can comprise a discharge nozzle. The discharge nozzle can be configured to dispense the foamed soap out of the foaming soap pump.

In some embodiments, the pumping unit can comprise a plurality of compartments. In certain variants, each compartment can have a respective resilient member. The plurality of compartments can be about equally, or unequally, circumferentially spaced around an outlet conduit of the pumping assembly.

In certain embodiments, the resilient member can comprise a rubber diaphragm. In the first state the resilient member can have a convex shape. In the second state the resilient member can have a concave shape. In some embodiments, the foaming unit can comprise a screen in the flow path of the soap. The discharge nozzle can comprise an anti-drip valve.

The foaming soap pump can comprise a lighting assembly. The lighting assembly can comprise a light source and/or a light pipe. In some embodiments, the foaming soap pump can comprise a sensor device. The sensor device can be configured to detect the presence of an object adjacent the dispensing assembly. In some embodiments, the pumping unit can comprise a one-way valve. The one-way valve can be configured to permit soap to enter the compartment through an inlet passage. In some embodiments, the foaming soap pump can comprise an air inlet assembly. The air inlet can be configured to allow ambient air to enter the flow of liquid soap.

In some embodiments, the fluid storage unit can comprise a sleeve. The sleeve can be threadably connected with the reservoir. In some embodiments, the actuation member can comprise an arm. The arm can extend radially outward from a drive shaft connected with the motor.

Certain embodiments disclosed herein include a method of dispensing foamed soap. The method can comprise drawing liquid soap from a reservoir. The method can comprise mixing the liquid soap with air to form aerated soap. The method can comprise encouraging the aerated soap into and out of a pumping assembly. The method can comprise converting the aerated soap into foamed soap. The method can comprise dispensing the foamed soap through a nozzle.

In some implementations, converting the aerated soap into foamed soap can comprise passing the aerated soap through a screen. In some embodiments, encouraging the aerated soap into and out of the pumping assembly can comprise expanding a portion of a compartment to introduce the aerated soap into the compartment. In some embodiments, encouraging the aerated soap into and out of the pumping assembly can comprise collapsing a portion of the compartment to expel the aerated soap from the compartment.

Some embodiments disclosed herein include a dispensing device. The dispensing device can comprise a reservoir. The reservoir can be configured to store a liquid product. The dispensing device can comprise a pumping assembly. The pumping assembly can be configured to draw the liquid product from the reservoir and to draw air through an air inlet, the liquid product and the air mixing to form an aerated product. The pumping assembly can comprise a plurality of compartments. The pumping assembly can comprise a plurality of resilient members. In some embodiments, each of the compartments can comprise at least one of the resilient members. Each of the resilient members can be movable between a convex state and a concave state. Each resilient member can extend outward of its respective compartment in the convex state. Each resilient member can extend into its respective compartment in the concave state.

The dispending device can comprise a motor. The motor can be configured to drive an actuation member. The actuation member can be configured to engage and disengage with the resilient members. Thus, in some embodiments the resilient members can be moved between the convex state and the concave state. This movement can provide a flow of aerated product into and out of the compartments.

The dispensing device can comprise a foaming unit. The foaming unit can be configured to convert the aerated product into a foamed product. The dispensing device can comprise a discharge nozzle. The discharge nozzle can be configured to dispense the foamed product out of the dispensing device.

The foaming unit can comprise a screen in the flow path of the aerated product. In some embodiments, the product can comprise soap. The resilient member can comprise a rubber diaphragm. In some embodiments, the discharge nozzle can comprise an anti-drip valve.

In some embodiments, the dispensing device can comprise a lighting assembly. The lighting assembly can comprise a light source and a light pipe. In some embodiments, each compartment can comprise a one-way valve. The one-way valve can be configured to permit aerated product to enter the compartment through an inlet passage.

Some embodiments disclosed herein include a reservoir. The reservoir can be configured to removably engage with a pumping assembly. The reservoir can comprise a top. The top can comprise an outlet. The outlet can comprise a normally-closed valve. The reservoir can comprise a bottom. The reservoir can comprise a sidewall. The reservoir can comprise an inner chamber. The inner chamber can be configured to contain a volume of liquid soap. When the reservoir is engaged with the pumping assembly, a projection of the pumping assembly can be received in the valve of the top of the reservoir. This can thereby allow opening the valve and allowing liquid soap to flow out of the reservoir.

In some embodiments, the top of the reservoir can comprise an engaging feature. The engaging feature can be configured to engage with a corresponding engaging feature of the pumping assembly to couple the reservoir and the pumping assembly. In some embodiments, the top of the reservoir can comprise a recess. The recess can be configured to receive a portion of a motor when the reservoir is engaged with the pumping assembly.

In some embodiments, the engaging feature can comprise a recess with a flange and the corresponding engaging feature comprises an arm with a tooth. The recess can be configured to receive the tooth. The flange can be configured to abut with the tooth to maintain the coupling of the reservoir and the pumping assembly. In some embodiments, the engaging feature can be configured to engage with a second tooth. This engagement can deflect the arm outward. This engagement can remove the abutment of the flange and the tooth.

In some embodiments, the reservoir can comprise a conduit. The conduit can be in fluid communication with the outlet. A lower end of the conduit can be positioned adjacent a lower end of the chamber. In some embodiments, when the reservoir is engaged with the pumping assembly, the reservoir can support the weight of the pumping assembly.

Combinations of various features are also within the scope of this disclosure. For example, this disclosure includes a combination of the pumping assembly and the reservoir above or below. Some embodiments of the foaming soap pump comprise the reservoir described above or below. Certain embodiments of the dispensing device comprise the reservoir described above or below.

BRIEF DESCRIPTION OF THE DRAWINGS

Certain features, aspects, and advantages of the subject matter disclosed herein are described below with reference to the drawings, which are intended to illustrate and not to limit the scope of the disclosure. Various features of different disclosed embodiments can be combined to form additional embodiments, which are part of this disclosure. No structures, features, steps, or processes are essential or critical; any can be omitted in certain embodiments.

DETAILED DESCRIPTION OF CERTAIN EMBODIMENTS

Various improved dispensing devices are disclosed herein. The disclosed embodiments are described in the context of a foaming soap pump, due to particular utility in that context. However, the inventions disclosed herein can also be applied to other types of devices and in other contexts. For example, some or all of the subject matter disclosed herein can be used in other types of foam producers and/or dispensers, such as shaving cream dispensers, foamed-food dispensers, bubble dispensers, and otherwise.

I. FIG. 1

Figure 1:
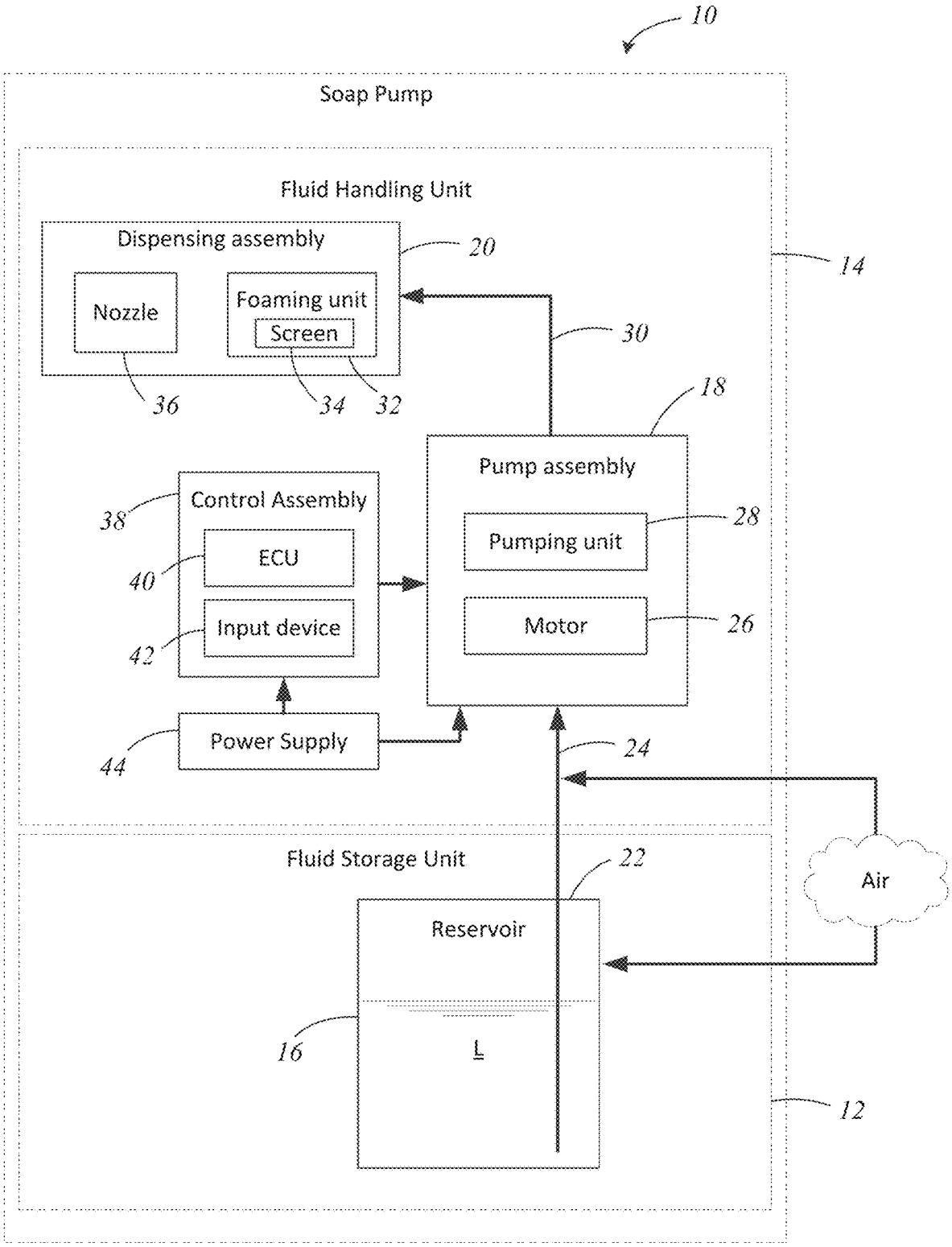
FIG. 1 schematically illustrates an embodiment of a foaming soap pump.

FIG. 1 schematically illustrates an embodiment of a foaming soap pump 10. As shown, the dispenser 10 includes a fluid storage unit 12 and a fluid handling unit 14. In various embodiments, the fluid storage unit 12 and the fluid handling unit 14 are coupled, such as by a mechanism to enable selective coupling and decoupling. As shown, the fluid storage unit 12 can include a reservoir 16. The fluid handling unit 14 can include a pump assembly 18 and a discharge assembly 20. In various embodiments, the dispenser 10 is configured to withdraw liquid soap from the reservoir 16, convert the soap to foamed soap, and dispense the foamed soap from the discharge assembly 20.

The reservoir 16 can be any type of container, such as a rigid vessel, flexible bag or balloon, or otherwise. In the illustrated embodiment, the reservoir 16 is configured to contain a volume of liquid soap, such as liquid soap for hand washing. In some embodiments, the reservoir 16 can include a lid configured to form a seal at the top of the reservoir 16 for maintaining the liquid soap L within the reservoir 16. In some embodiments, the reservoir 16 can include an air vent, so as to allow air to enter the reservoir 16 as the level of liquid soap L falls within the reservoir 16. As illustrated, the reservoir 16 can be positioned below (e.g., at a lower elevation than) the pump assembly 18. In some variants, a top of the reservoir 16 is positioned at a higher elevation than a portion of the pump assembly 18, such as a portion of the pump assembly 18 being received in a recess in the reservoir 16 (e.g., to reduce the overall height of the dispenser 10).

The reservoir 16 can include an outlet 22, such as an aperture in an upper portion of the reservoir 16. The outlet 22 can receive a conduit 24, such as a length of tubing. The conduit 24 can fluidly connect the reservoir 16 and the pump assembly 18. In some embodiments, the pump assembly 18 is configured to draw a flow of liquid soap from the reservoir 16 and through the conduit 24. Certain embodiments include a fluid conveyor (e.g., a worm-screw, auger, or otherwise) that is configured to aid in withdrawing liquid soap from the reservoir 16 and/or conveying liquid soap to the pump assembly 18. In some embodiments, the conduit 24 includes a vent that enables air to enter the conduit 24, which can facilitate converting the liquid soap into aerated soap and/or foamed soap. In some variants, the vent is in the pump assembly 18. As illustrated, the conduit 24 can extend into the reservoir 16. For example, the conduit 24 can terminate at a bottom inner portion of the reservoir 16.

As shown, the pump assembly 18 can include a motor 26 and a pumping unit 28. The motor 26 can be configured to drive the pumping unit 28. The motor 26 and the pumping unit 28 can be configured to draw liquid soap from the reservoir 16 and encourage the soap to the discharge assembly 20. For example, the motor 26 can drive an arm that alternatingly compresses and expands one or more resilient diaphragms in the pumping unit 28, thereby encouraging a flow of liquid soap into and out of the pump assembly 18. In some embodiments, the pumping unit 28 can be a rolling pump, roller pump, diaphragm pump, or other type of pump. In some variants, the pumping unit 28 is configured to facilitate foaming of the liquid soap.

The pump assembly 18 can be connected to the discharge assembly 20 by a conduit 30. In some embodiments, the discharge assembly 20 includes a foaming unit 32, which can be configured to convert some or all of the liquid soap into foamed soap. In some implementations, the foaming unit 32 includes a flow enhancing member, such as a screen 34. The screen 34 can be located in the flow path of the foamed soap such that the foamed soap passes through the screen 34, thereby foaming the soap.

In some embodiments, the discharge assembly 20 includes a discharge nozzle 36. The discharge nozzle 36 can be configured to dispense the foamed soap and/or to inhibit undesired dripping of soap (liquid or foamed) after a dispensing cycle ends. For example, the discharge nozzle 36 can include a one-way valve, such as a pin valve or duckbill valve, which can reduce the likelihood of drips.

In some embodiments, the nozzle 36 is positioned at a location that is spaced above a lower portion of the soap pump 10, such as at or near the top of the soap pump 10. This can make it more convenient for a user to place a hand or other body part under the nozzle 36. In some implementations, the nozzle 36 is located on a cantilevered portion that extends outward from an upper portion of the soap pump 10.

Certain embodiments include a control assembly 38. As shown, the control assembly 38 can include an electronic control unit (ECU) 40. The ECU 40 can include one or a plurality of circuit boards providing a hard wired feedback control circuit, a processor and memory devices for storing and performing control routines, or any other type of controller. The ECU 40 can be configured to control operation of the pumping assembly 18 and/or other components of the soap pump 10.

In some embodiments, the control assembly 38 includes a user input device 42. The user input device 42 can be any type of device for allowing a user to input a command into the ECU 40. For example, the input device 42 can be a button that a user can activate (e.g., depress) to transmit a command to the ECU 40. In some embodiments, the ECU 40 can be configured to actuate the motor 26 to drive the pumping unit 28 in response to the input device 42 being activated by a user. The ECU 40 can also be configured to provide other functions upon the activation of the input device 42, such as signaling the soap pump 10 to dispense a predetermined amount (e.g., an amount suitable for washing hands or an amount suitable for washing cookware) or a continuous flow of foam soap. As shown, in some embodiments, the control assembly 38 comprises the input device 42. The input device 42 can be located in the discharge assembly 20 or in other components of the dispenser 10.

Various embodiments include a power supply 44. The power supply 44 can be configured to supply electric power to the motor 26 and/or the control assembly 38. The power supply 44 can be, for example, a battery or can include electronics for accepting AC or DC power. As shown, the power supply 44 can be located in the fluid handling unit 14. In some variants, the power supply 44 is located in the fluid storage unit 12.

II. FIGS. 2-19

Figure 2:
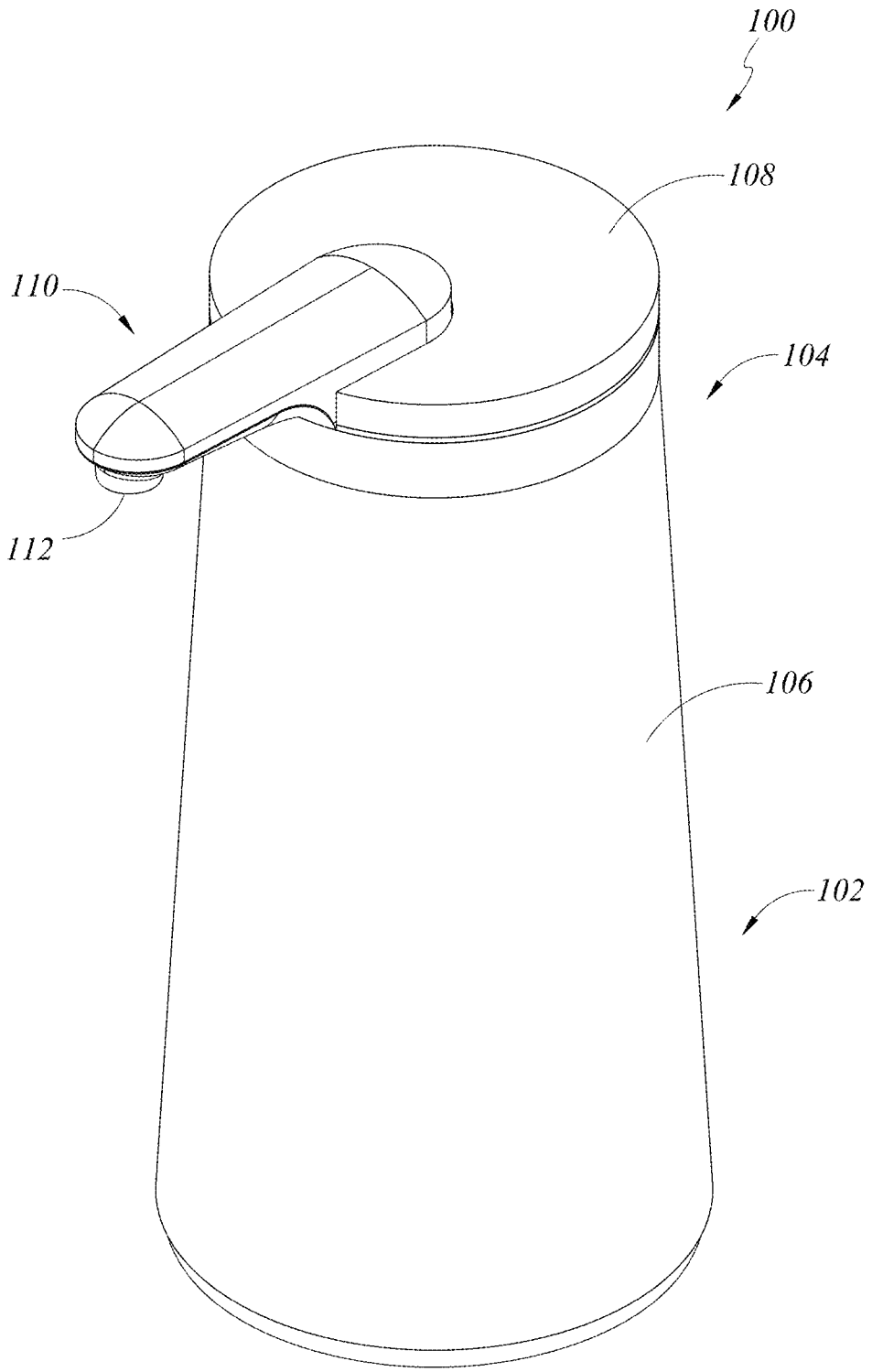
FIG. 2 illustrates a top perspective view of another embodiment of a foaming soap pump, including a fluid storage unit and a fluid handling unit.
Figure 3:
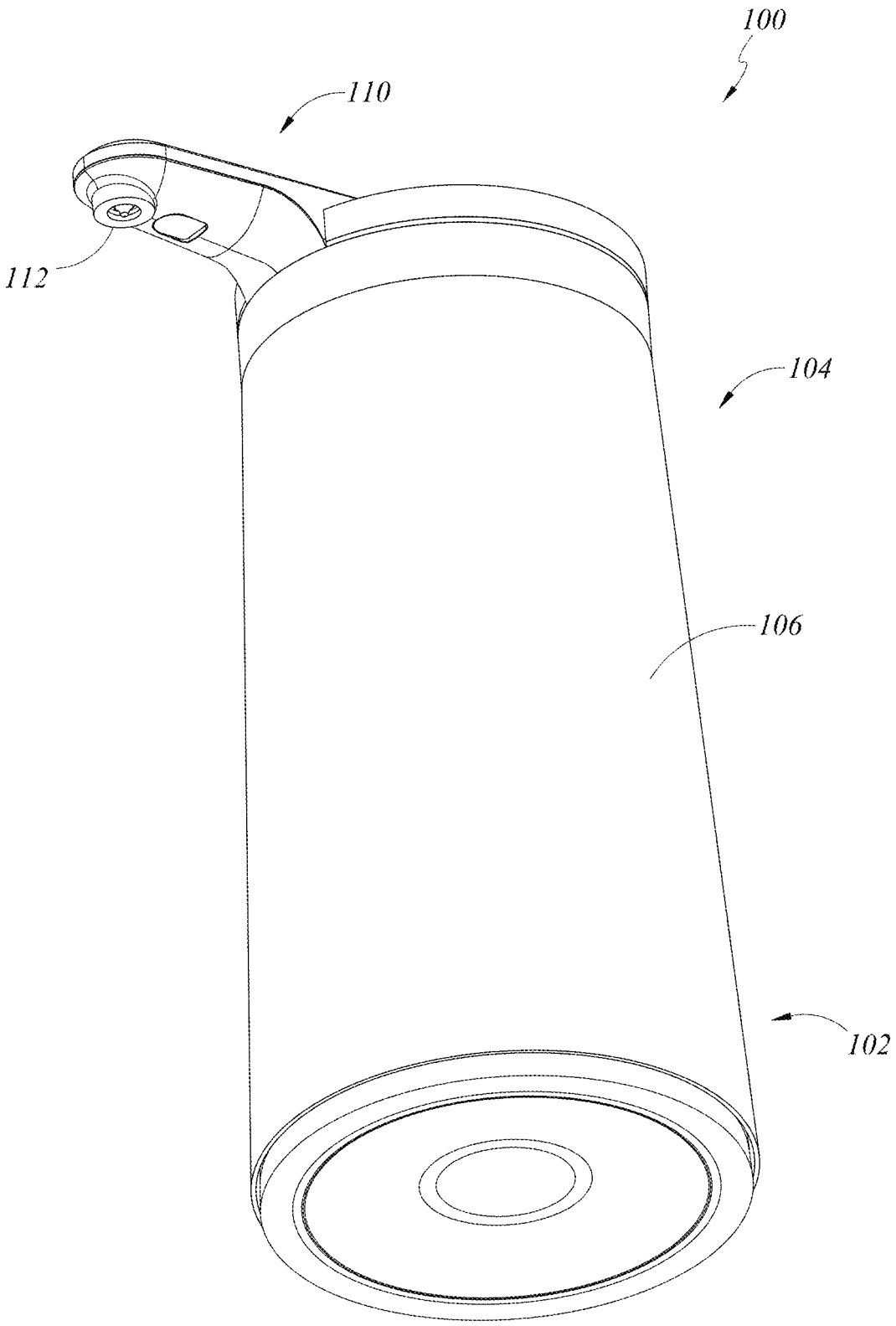
FIG. 3 illustrates a bottom perspective view of the soap pump of FIG. 2.

FIGS. 2-19 illustrate another embodiment of a dispenser device, such as a soap pump 100. The soap pump 100 can include any of the features of the soap pump 10. For example, the soap pump 100 can include a fluid storage unit 102 and a fluid handling unit 104. As shown in FIGS. 2 and 3, the soap pump 100 can include an outer housing 106, such as an outer sleeve. In some embodiments, the outer housing 106 can partially or completely contain the fluid storage unit 102 and/or the fluid handling unit 104, which can include any of the features of the fluid storage unit 12 and the fluid handling unit 14, respectively. The fluid handling unit 104 can include a reservoir 120 that is configured to store liquid soap.

As illustrated, in some embodiments, the outer housing 106 can surround some or all of the fluid storage unit 102 and a fluid handling unit 104. In some embodiments, the outer housing 106 has a generally cylindrical or generally frustoconical shape. The outer housing 106 can include features to enhance the visual appearance of the soap pump 100, such as a color, pattern, material, etc. In some embodiments, the outer housing 106 can be readily removable from the fluid storage unit 102 and/or the fluid handling unit 104. This can enable a user to change the visual appearance of the soap pump 100. For example, a user can remove a first version of the outer housing and replace it with a second version of the outer housing (e.g., with different color, pattern, material, etc.). Certain embodiments include a system comprising the fluid storage unit 102, fluid handling unit 104, and a plurality of outer housings 106.

In some embodiments, the soap pump 100 is configured to aid a user in determining whether the liquid soap in the reservoir 120 is nearly exhausted. For example, the soap pump 100 can include a gap, such as between a bottom of the outer housing 106 and a bottom of the reservoir 120. The gap can allow a user to see whether soap is present in the reservoir 120. In certain implementations, the gap is at least about: 3 mm, 5 mm, 8 mm, 10 mm, 15 mm, 20 mm, values between the aforementioned values, or other values. In some embodiments, the outer housing 106 includes a slit or window, such as a generally vertical notch. In certain variants, the slit or window can enable a user to view the amount of liquid soap in the reservoir 120. Some variants include indicia to indicate the information related to the amount of liquid soap in the reservoir 120, such as the volume and/or number of dispensations remaining.

Certain embodiments of the soap pump 100 include a lid 108, such as a hinged or removable top. The lid 108 can be moved between open and closed positions. In the closed position, the lid can protect portions of the soap pump 100, such as by inhibiting or preventing water (e.g., from a nearby sink) from entering the fluid storage unit 102. In the open position, the lid can facilitate ready access to a portion of the fluid handling unit 104.

As illustrated, the soap pump 100 can include a dispensing assembly 110. The dispensing assembly 110 can include a nozzle 112, through which foamed soap is dispensed. As shown, the nozzle 112 can be positioned on a portion of the dispensing assembly 110 that extends outward from (e.g., is cantilevered from) an upper portion of the housing 106. This can make it more convenient for a user to place a hand or other body part under the nozzle 112 to receive a quantity of foamed soap.

Figure 4:
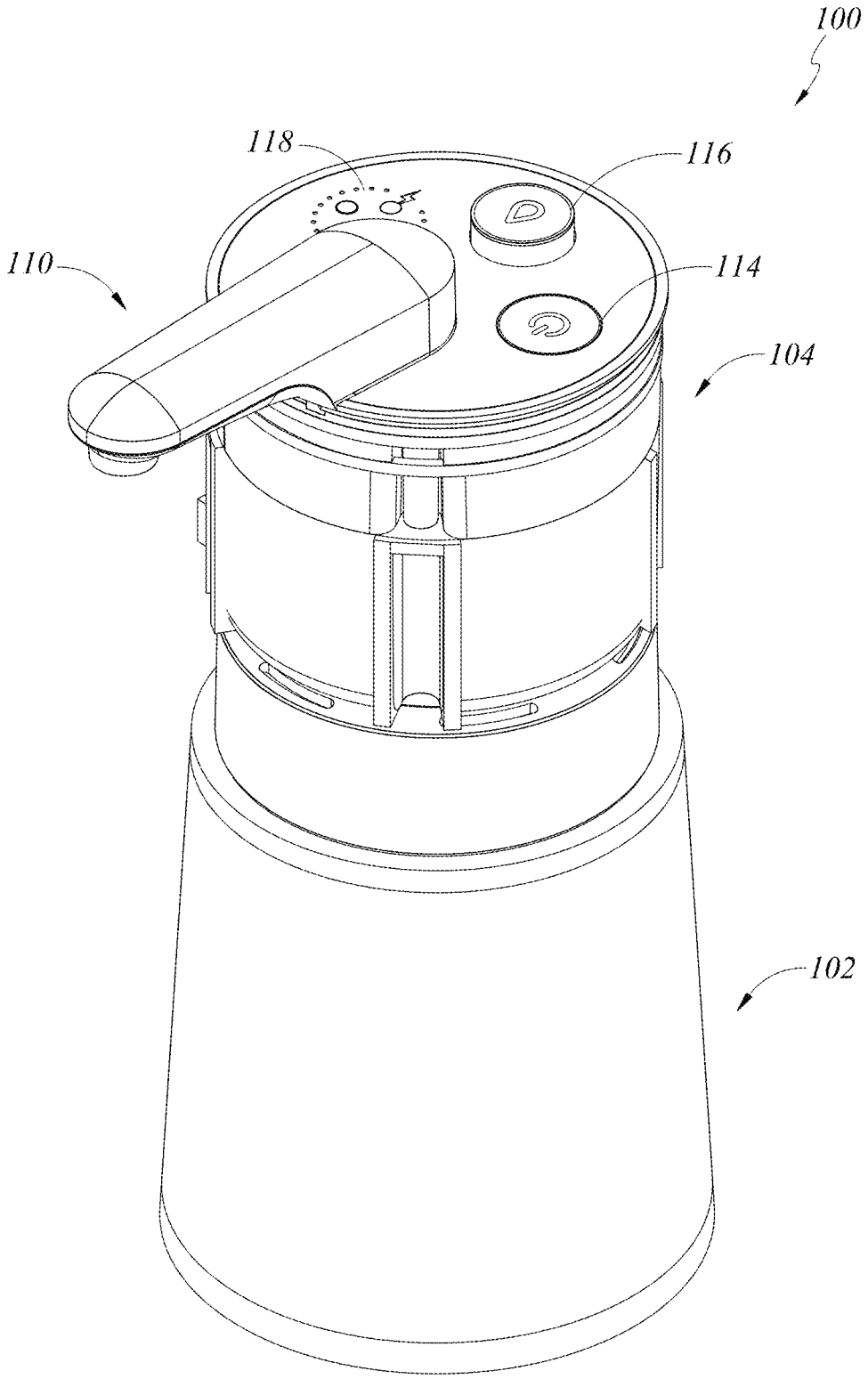
FIG. 4 illustrates a top perspective view of the soap pump of FIG. 2 with an outer housing and a lid removed.
Figure 5:
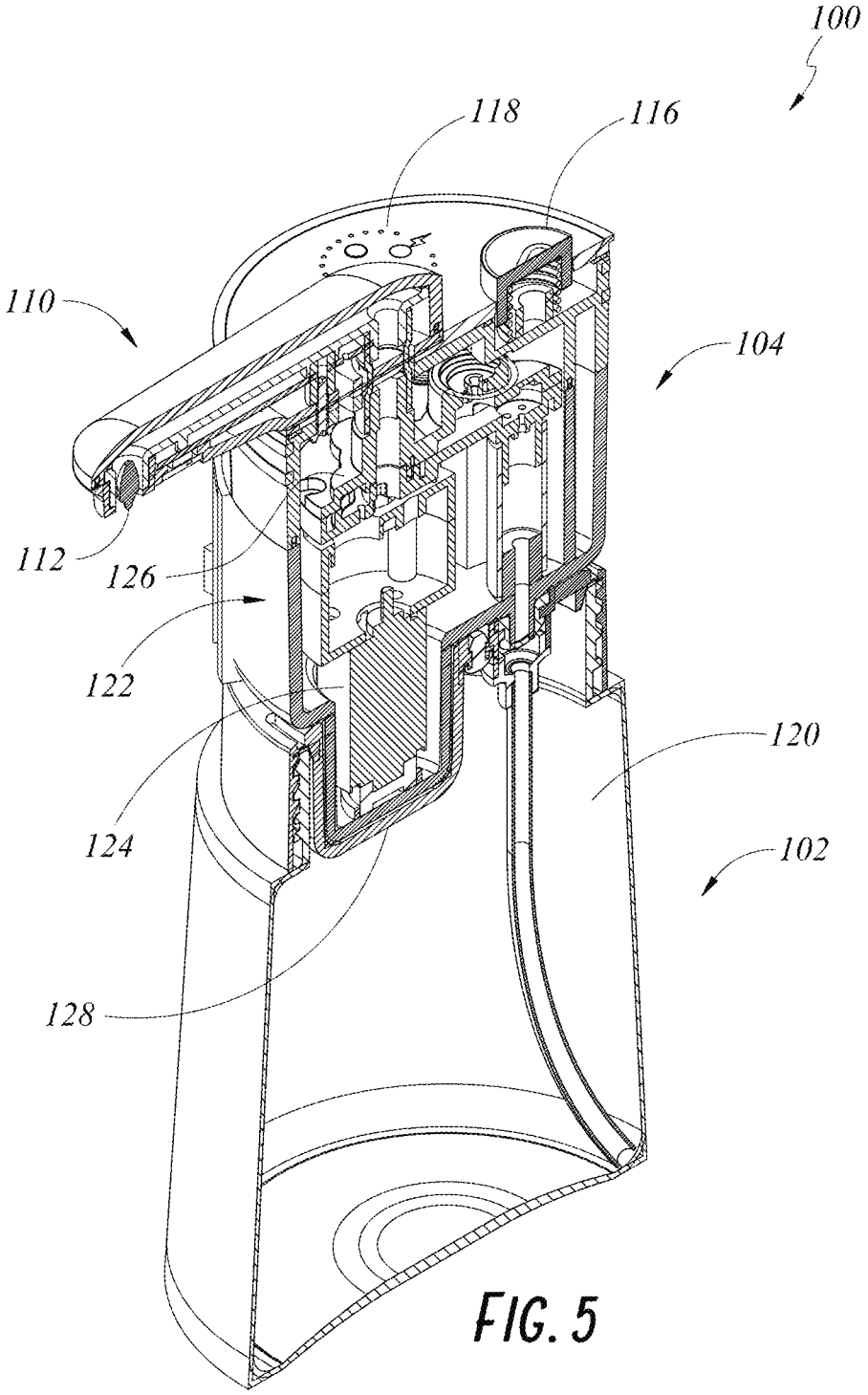
FIG. 5 illustrates a top perspective cross-sectional view of the soap pump of FIG. 4.
Figure 6:
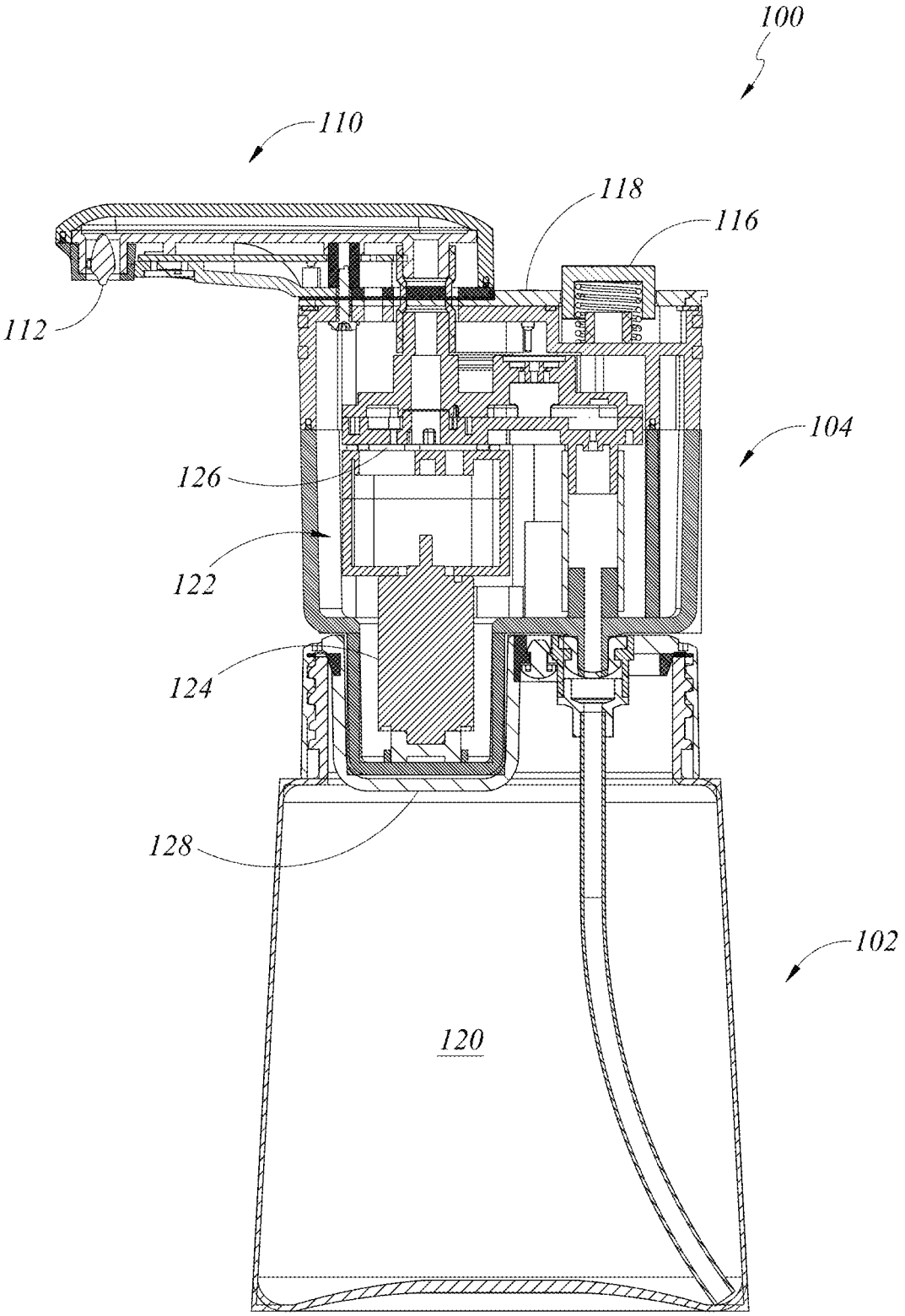
FIG. 6 illustrates a side cross-sectional view of the soap pump of FIG. 4.
Figure 7:
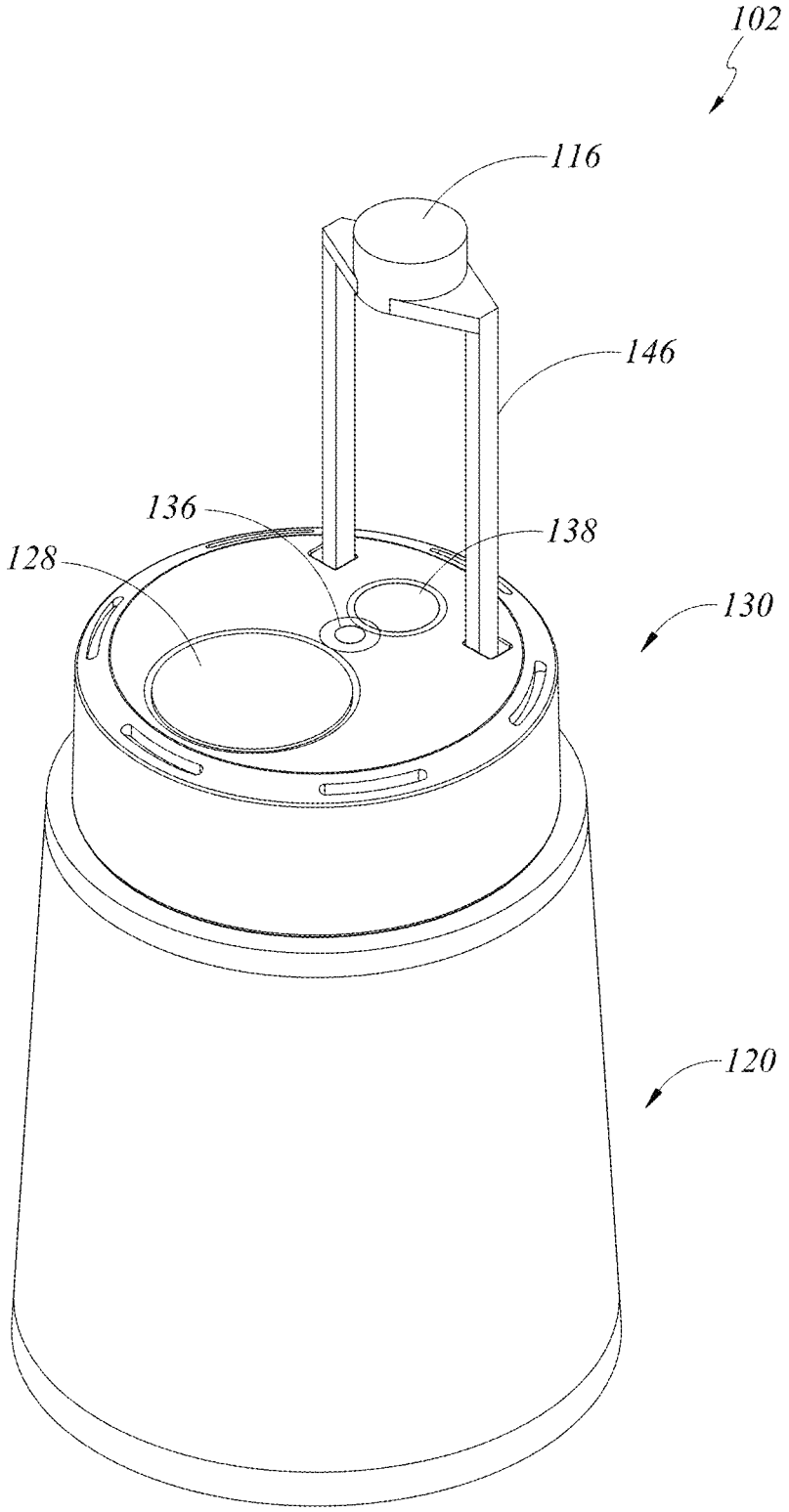
FIG. 7 illustrates a top perspective view of the fluid storage unit of the soap pump of FIG. 4.
Figure 8:
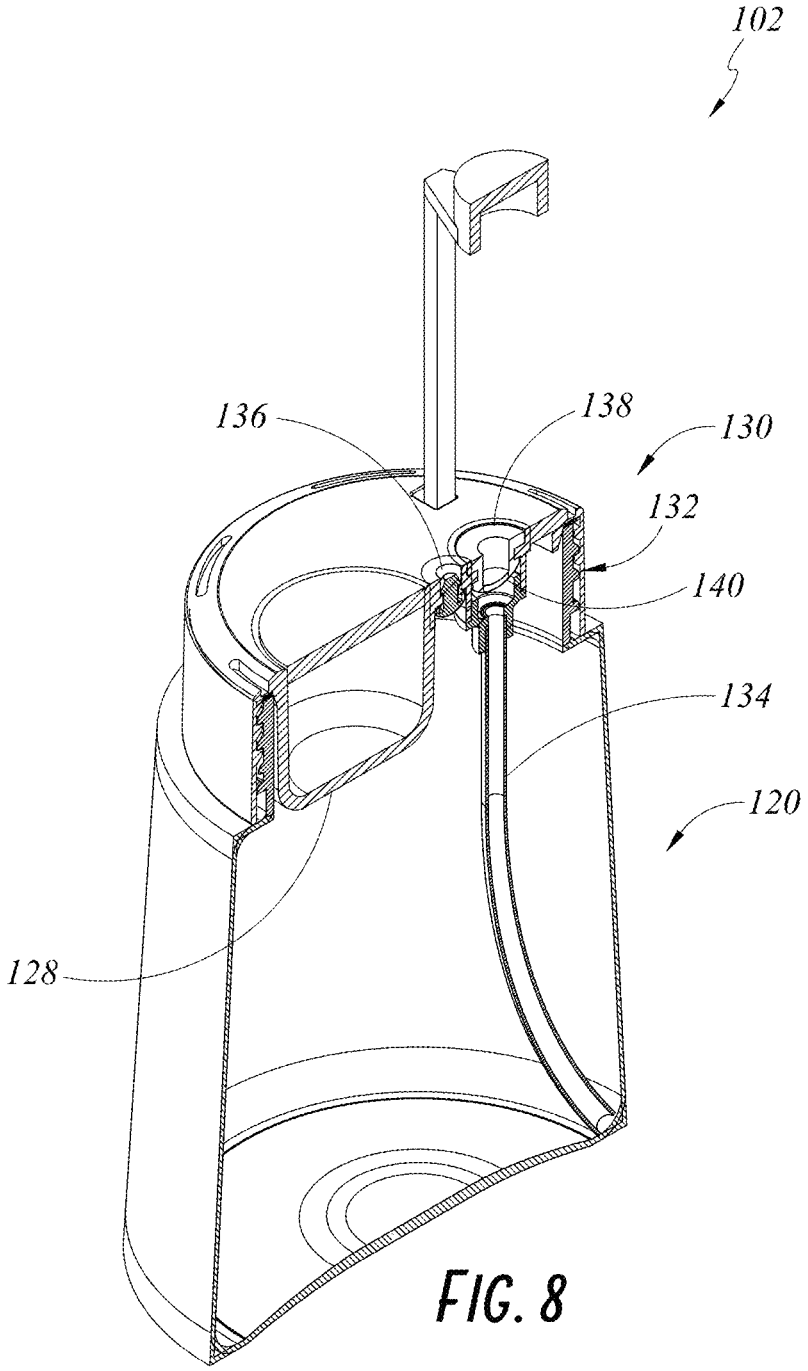
FIG. 8 illustrates a top perspective cross-sectional view of the fluid storage unit of FIG. 7.
Figure 9:
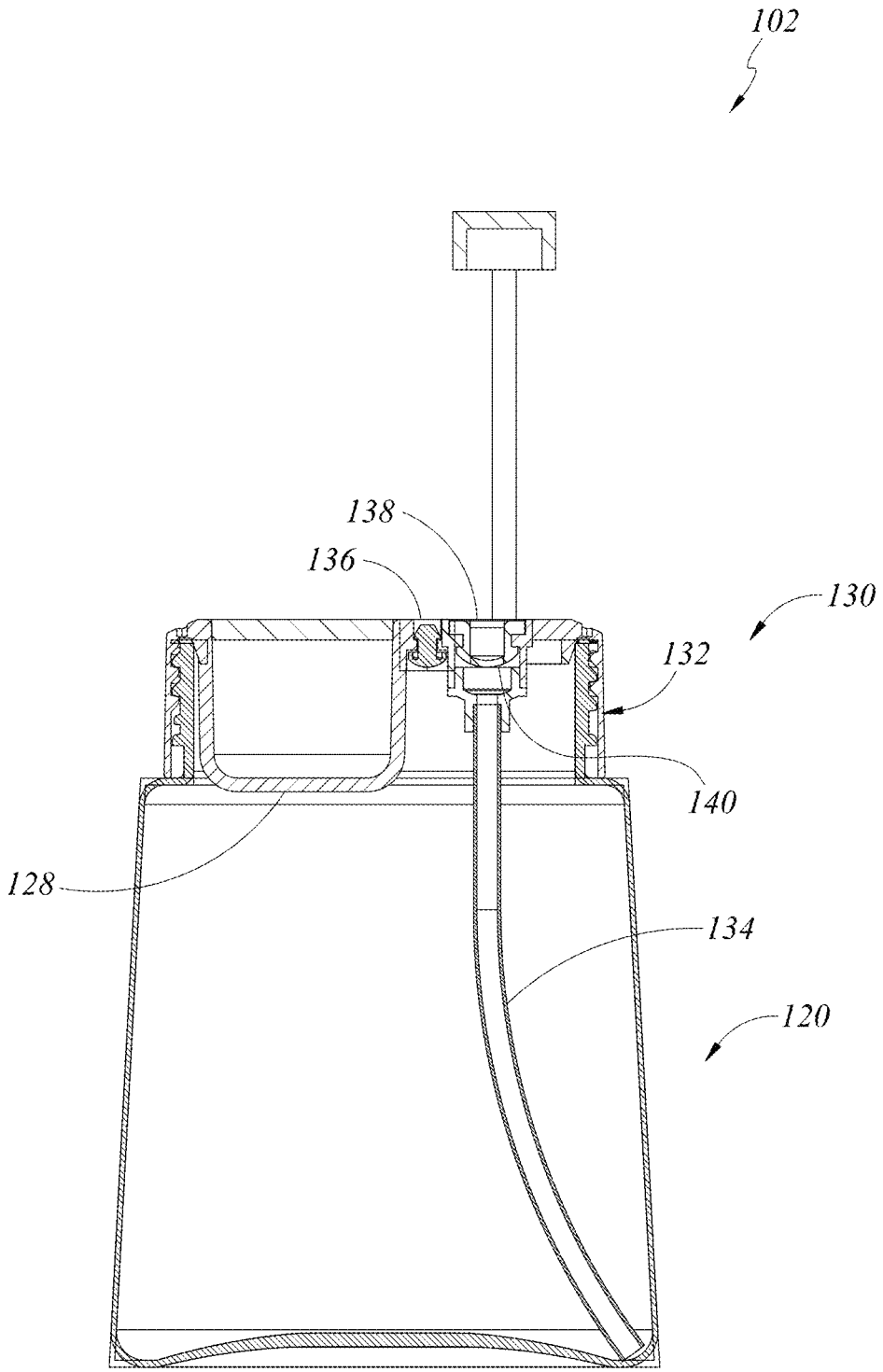
FIG. 9 illustrates a side cross-sectional view of the fluid storage unit of FIG. 7.
Figure 10:
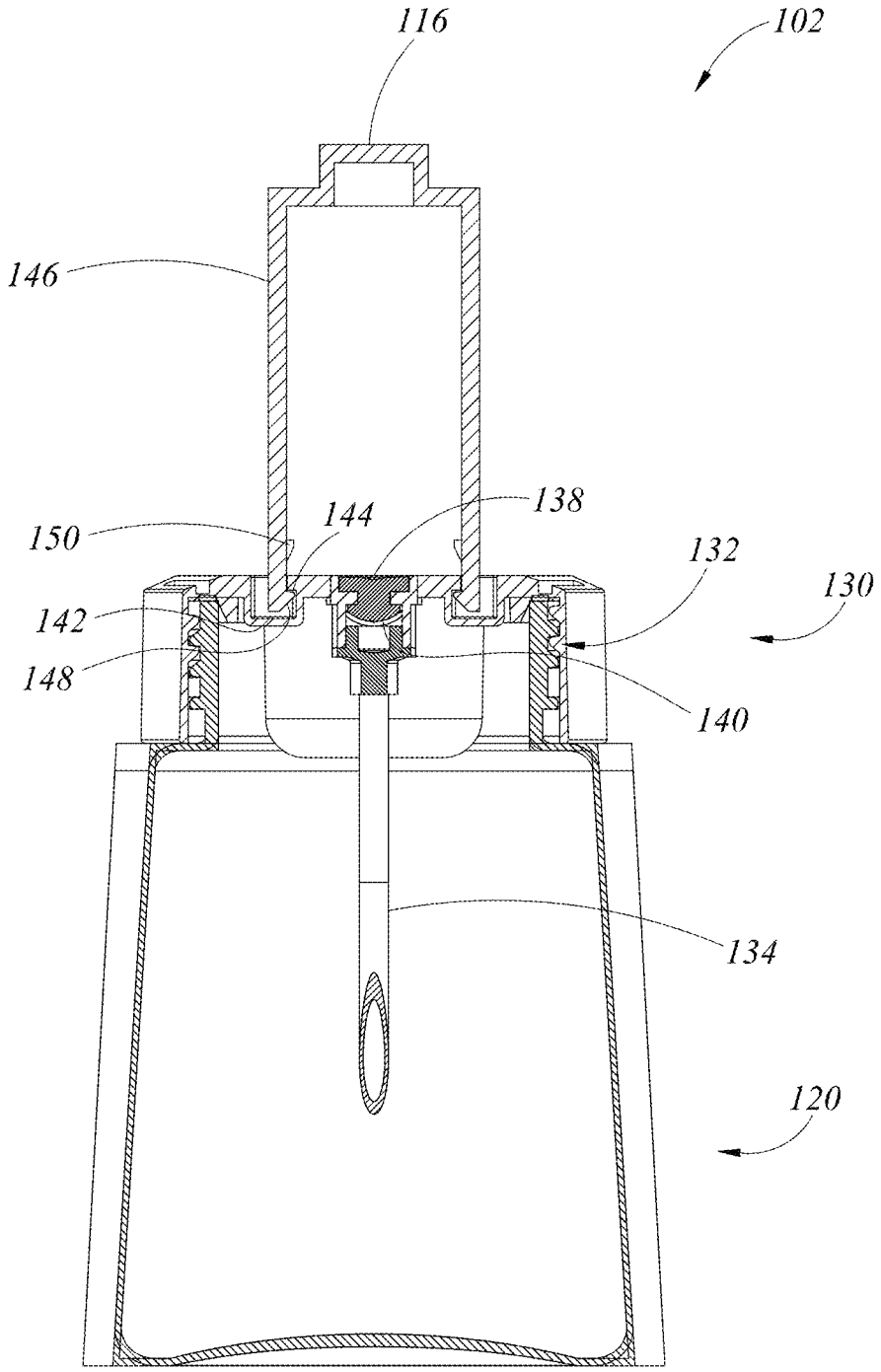
FIG. 10 illustrates a rear cross-sectional view of the fluid storage unit of FIG. 7.
Figure 11:
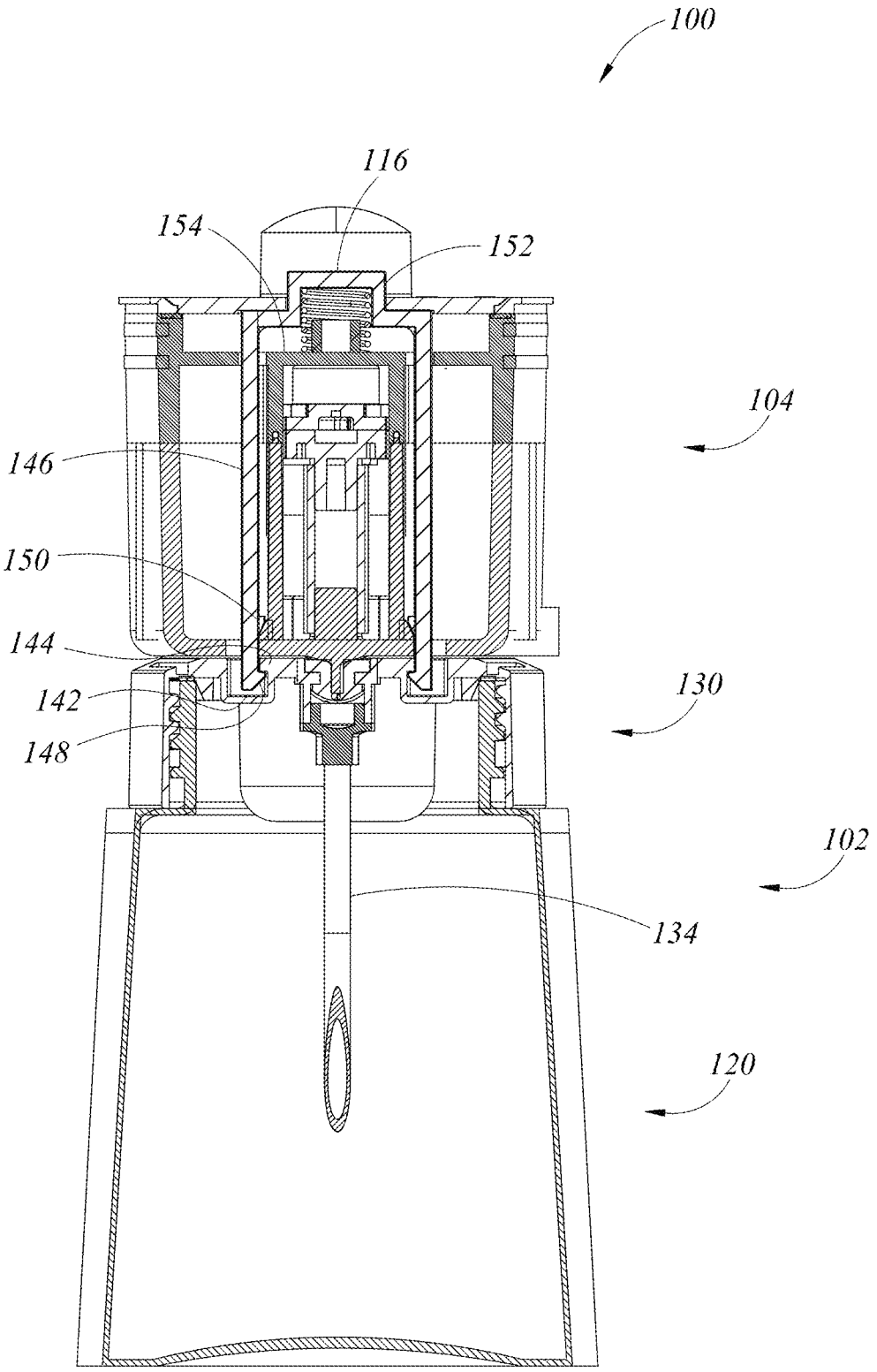
FIG. 11 illustrates a rear cross-sectional view of the soap pump of FIG. 2.

FIGS. 4-6 illustrate the soap pump 100 with the outer housing 106 and the lid 108 removed. As discussed in more detail below, the fluid storage unit 102 can include the reservoir 120, which can be configured to store liquid soap. The fluid handling unit 104 can include a pumping assembly 122 that includes a motor 124 and a pumping unit 126.

As shown, the fluid handling unit 104 can be positioned above the fluid storage unit 102. For example, the fluid handling unit 104 can be supported by the fluid storage unit 102. An elevated fluid handling unit 104 (e.g., relative to the fluid storage unit 102 and/or the surface on which the soap pump 100 rests) can position one or more input devices in a position that is more convenient for a user. For example, as shown, a power actuator 114, coupling actuator 116, and/or power supply 118 can be accessed via a top of the fluid handling unit 104. In some embodiments, a portion of the fluid handling unit 104 is received in the fluid storage unit 102. For example, as shown, a lower portion of the motor 124 can be received in a recess 128 in the reservoir 120. This can aid in reducing the overall size (e.g., height) of the soap pump 100. In certain implementations, an axial centerline of the fluid handling unit 104 is substantially collinear with an axial centerline of the fluid storage unit 102. In various embodiments, the fluid storage unit 102 and the fluid handling unit 104 can be selectively coupled and decoupled, as is discussed below in more detail.

A. Fluid Storage Unit

FIGS. 7-11 illustrate an example of the fluid storage unit 102. As mentioned above, the fluid storage unit 102 can include the reservoir 120. The reservoir 120 can be any type of container, such as a vessel, bag, balloon, or otherwise. Typically, the reservoir 120 is configured to contain a volume of liquid soap, such as liquid soap for hand washing or dish washing. In some embodiments, the reservoir 120 comprises a cartridge. As shown, the reservoir 120 can include a top, bottom, and sidewall. The reservoir 120 can include a chamber for containing the liquid soap. In some embodiments, at a temperature of about 21° C. and a pressure of about 1 atmosphere, the liquid soap has a viscosity of at least about: 85 cP, 90 cP, 95 cP, 100 cP, 105 cP, 110 cP, 120 cP, viscosities between the aforementioned viscosities, or other viscosities.

In some embodiments, the fluid storage unit 102 includes a sleeve 130. The sleeve 130 can be configured to connect and/or disconnect with the reservoir 120, such as with a threaded connection 132. This can enable the reservoir 120 to be selectively disconnected, such as by unscrewing the threaded connection when the volume of liquid soap in the reservoir 120 is substantially exhausted. In some embodiments, the reservoir 120 is a reusable item. For example, the disconnected reservoir 120 can be configured to be refilled with liquid soap (e.g., via an upper aperture in the reservoir 120) and then reconnected with the sleeve 130. In some variants, the reservoir 120 is a disposable item. For example, the disconnected reservoir 120 can be discarded and replaced with another reservoir.

The fluid storage unit 102 can include a conduit 134, such as a flexible tube. The conduit 134 can extend into the reservoir 120. As shown, the conduit 134 can terminate at or near a bottom end inside the reservoir 120. In certain embodiments, the longitudinal length of the conduit 134 is greater than the height of the reservoir 120. As shown, this can result in the conduit 134 bending within the reservoir 120 and/or an end of the conduit 134 being positioned against or adjacent a radially outside wall of the reservoir 120. In some embodiments, the reservoir 120 has a concave bottom, which can encourage liquid soap toward a periphery of the reservoir 120 and/or toward the end of the conduit 134.

In some embodiments, the fluid storage unit 102 includes an air vent 136. The air vent 136 can allow air to enter the reservoir 120 as the level of liquid soap L falls within the reservoir 120. In some embodiments, the air vent 136 includes a one-way valve, such as an umbrella valve, that is configured to allow air to enter the reservoir 120.

With continued reference to FIGS. 7-11, the fluid storage unit 102 can include an outlet 138, such as an opening in an upper portion of the fluid storage unit 102. As shown, the outlet 138 can be connected with the conduit 134. In various embodiments, the liquid soap can flow through the conduit 134 and the outlet 138 and be provided to the fluid handing unit 104. In some implementations, the outlet 138 is configured to engage with a portion of the fluid handing unit 104, such as by the outlet 138 receiving a protruding portion of the fluid handing unit 104. In certain implementations, when the outlet 138 is engaged with the fluid handing unit 104, the outlet 138 is configured to allow liquid soap to flow through the outlet 138.

In some embodiments, the outlet 138 includes a connection feature, such as a seal or valve 140. In certain implementations, in response to the outlet 138 being engaged with the fluid handling unit 104, the valve 140 is opened, thereby placing the fluid handling unit 104 in fluid communication with the reservoir 120 via the outlet 138 and the conduit 134. In some variants, when the outlet 138 is not engaged with the fluid handling unit 104, the valve 140 is closed, thereby inhibiting or preventing liquid soap from flowing out of the fluid storage unit 102. In some embodiments, the valve 140 is a poppet valve and/or is mechanically displaced by engagement with a portion (e.g., a projection) of the fluid handling unit 104. For example, the valve 140 can be displaced in a direction substantially parallel with the axial axis of the soap pump 100. In certain variants, the valve 140 includes a normally-closed slit that can be opened by, and/or that can receive a portion of, the fluid handling unit 104. In some embodiments, the valve 140 is a one-way valve, such as a duckbill valve.

As mentioned above, the fluid storage unit 102 and the fluid handling unit 104 can be configured to selectively couple and decouple. Certain embodiments of the fluid storage unit 102 include features to facilitate such functionality. For example, the fluid storage unit 102 can include engaging features that engages with corresponding engaging features of the fluid handling unit 104. As shown in the cross-sectional views of FIGS. 10 and 11, in some embodiments, the engaging features of the fluid storage unit 102 include a recess 142 with a flange 144 and the engaging features of the fluid handling unit 104 include an arm 146 with a first and second teeth 148, 150. As shown, the arm 146 can connect with the coupling actuator 116 (e.g., button) and can be biased by a biasing member 152, such as a spring.

As also shown, when the fluid storage unit 102 and the fluid handling unit 104 are in the coupled state, the first tooth 148 of the arm 146 can be received in the recess 142 of the fluid storage unit 102. The tooth 148 can engage (e.g., abut against) the flange 144. In this configuration, the biasing member 152 is compressed between the coupling actuator 116 and a support 154, thus applying a generally upward force on the arm 146. However, the engagement of the tooth 148 with the flange 144 provides a physical interference, thereby maintaining the position of the arm 146, as well as the coupling between the fluid storage unit 102 and the fluid handling unit 104.

Some embodiments are decoupled by activating (e.g., depressing) the coupling actuator 116. This can displace the arm 146 downward relative to the fluid storage unit 102. In some embodiments, such movement of the arm 146 engages the second tooth 150 with a bottom portion of the fluid handling unit 104. This can displace the arm 146 (e.g., radially outward), which can remove the physical interference between the tooth 148 and the flange 144, thereby removing the coupling between the fluid storage unit 102 and the fluid handling unit 104.

B. Fluid Handling Unit

FIGS. 12-29 illustrate an example of the fluid handling unit 104. As mentioned above, the fluid handling unit 104 can receive a flow of liquid soap from the fluid storage unit 102 and/or can supply a flow of soap to the dispensing assembly 110.

Figure 12:
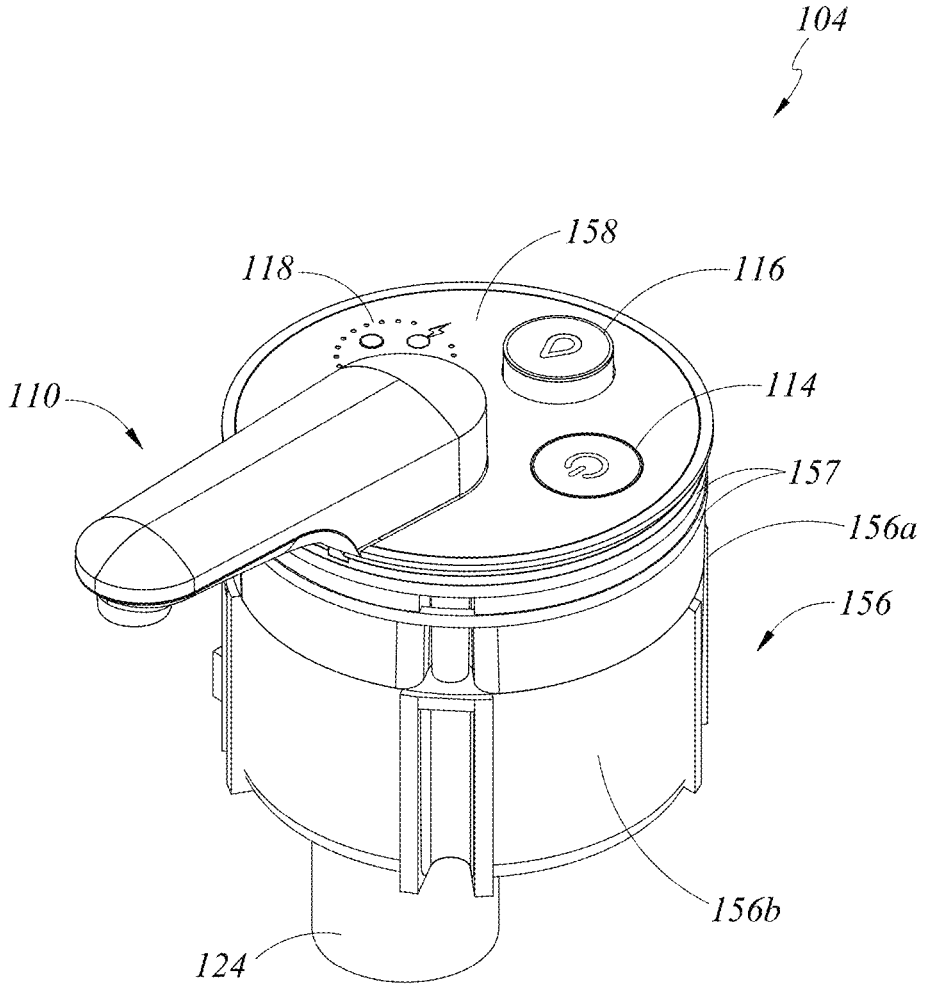
FIG. 12 illustrates a top perspective view of the fluid handling unit of the soap pump of FIG. 4.

As shown in FIG. 12, the fluid handling unit 104 can include a power actuator 114, coupling actuator 116, and/or power supply 118. The power actuator 114 can be configured to enable a user to turn the soap dispenser on and off. The coupling actuator 116 can be configured to facilitate coupling and decoupling of the fluid storage unit 102 and the fluid handling unit 104, as is discussed above.

In some embodiments, the power supply 118 includes a battery, capacitor, or other power storage device. In certain implementations, the power supply 118 is contained in the fluid handling unit 104. In some variants, at least a portion of the power supply 118 is located in the fluid storage unit 102. For example, in certain embodiments (e.g., in some embodiments in which the reservoir 120 is a disposable item), a battery or other power storage device is located in the fluid storage unit 102.

In some embodiments, the power supply 118 is configured to connect with an external power source for recharging, such as with a port or cord to connect with a universal serial bus (USB) cable and/or domestic power. In some embodiments, the power supply 118 is configured to engage with the cord. For example, the power supply 118 can include an engaging element (e.g., a magnet) that is configured to engage (e.g., magnetically couple) with a corresponding engaging element (e.g., another magnet) of the cord, which can aid in locating and/or securing the cord on the power supply 118. For example, some embodiments are configured such that, when the engaging elements of the power supply 118 are engaged with the engaging elements of the cord, a contact of the power supply 118 is automatically electrically connected with a contact of the cord, thereby allowing electrical power to be provided from the cord to the power supply 118. As shown, in some embodiments, the power supply 118 includes at least two engaging elements 118*a*, 118*b* and at least two contacts 118*c*, 118*d*. In certain implementations, the engaging elements 118*a*, 118*b* and contacts 118*c*, 118*d* are arranged in a circular shape. For example, as illustrated, the engaging elements 118*a*, 118*b* can be located on the circular shape at about 0° and about 180° and the contacts 118*c*, 118*d* can be located at about 90° and about 270°.

In some implementations, the power supply 118 is configured to engage with a head portion of the cord in multiple orientations and/or to enable a user to flip the head portion around yet still be able to engage with the power supply 118. For example, in the embodiment shown in FIG. 12, the head portion can engage with the contacts 118*c*, 118*d* in two positions (e.g., a first position as well as a second position that is flipped 180° from the first position). In some implementations, the power supply 118 and/or the head portion are configured to facilitate engagement. For example, one of the power supply 118 and the head portion can include a projection and the other of the power supply 118 and the head portion can include a recess configured to receive the projection. In some embodiments, the head portion of the cord has a generally cylindrical shape.

In various embodiments, the power supply 118 is sealed, such as with a gasket, adhesive, welds, or otherwise. This can reduce the chance of water intrusion into the power supply 118 and/or fluid handling unit 104. Certain implementations are configured to inhibit or prevent water from entering the power supply 118 and/or passing between the power supply 118 and a cover 158. For example, in some embodiments, the contacts 118*c*, 118*d* pass through corresponding openings in the cover 158 and the contacts 118*c*, 118*d* are sealed with the cover 158 such that water is inhibited or prevented from passing through the openings. In some embodiments, with the cover 158 installed (see FIG. 12) and from a top plan view of the fluid handling unit 104, the only portion of the power supply 118 that is visible is the contacts 118*c*, 118*d*. In some embodiments, the contacts 118*c*, 118*d* comprise a material that is electrically conductive and resistant to corrosion in the presence of freshwater, such as stainless steel, copper, aluminum, or otherwise.

In some embodiments, the fluid handling unit 104 is configured to avoid accumulating water in and/or near the power supply 118. This can reduce the chance of corrosion of the power supply 118 and/or other portions of the fluid handling unit 104. As previously mentioned, the power supply 118 can be accessed via a top of the fluid handling unit 104 through the contacts 118*c*, 118*d*. For example, as shown in FIG. 12, the contacts 118*c*, 118*d* can be positioned on a top of the fluid handling unit 104. In comparison to having contacts that are positioned on a lower portion or bottom of the soap dispenser, such top positioning of the contacts 118*c*, 118*d* can reduce or eliminate the chance of water dripping down a side of the soap dispenser and into the power supply 118 and/or can further space the contacts 118*c*, 118*d* apart from a potentially wet surface (e.g., a sink or counter) that the soap dispenser is resting on. As shown in FIG. 12, the contacts 118*c*, 118*d* can be substantially flush with the cover 158. In certain variants, the contacts 118*c*, 118*d* can protrude upward from the cover 158, such as by at least about 1 mm. In some embodiments, the contacts 118*c*, 118*d* are positioned in a bulge of the cover 158, such as a hemispherical or frustoconical bulge. In various implementations, the contacts 118*c*, 118*d* are not positioned in a recess.

Certain embodiments include a casing 156, such as a rigid plastic or metal shell. In some embodiments, the casing 156 includes an upper portion 156*a* and lower portion 156*b*. The portions 156*a*, 156*b* can be joined together, such as with fasteners, adhesive, and/or welding (e.g., ultrasonic welding). The casing 156 can be configured to protect and/or retain some or all of the components of the fluid handling unit 104, such as the motor 124 and pumping unit 126. In some embodiments, the casing 156 includes one or more seals 157 (e.g., rubber gaskets) that are configured to engage with the outer housing 106 and/or to inhibit water from passing between the casing 156 and the outer housing 106.

As mentioned above, in some implementations, the fluid handling unit 104 includes a cover 158. The cover 158 can engage with the casing 156 to seal and/or protect components of the fluid handling unit 104, such as the motor 124 and pumping unit 126. For example, the engagement between the cover 158 and the casing 156 can inhibit water and dirt from entering the fluid handling unit 104. In some embodiments, the cover 158 engages a seal (e.g., a rubber gasket) to provide a generally liquid tight seal. In certain embodiments, the cover 158 is configured to shed water. For example, the cover 158 can be pitched, such as being higher at the radial middle than at the radial edge. In some embodiments, the cover 158 is substantially flat.

Figure 13:
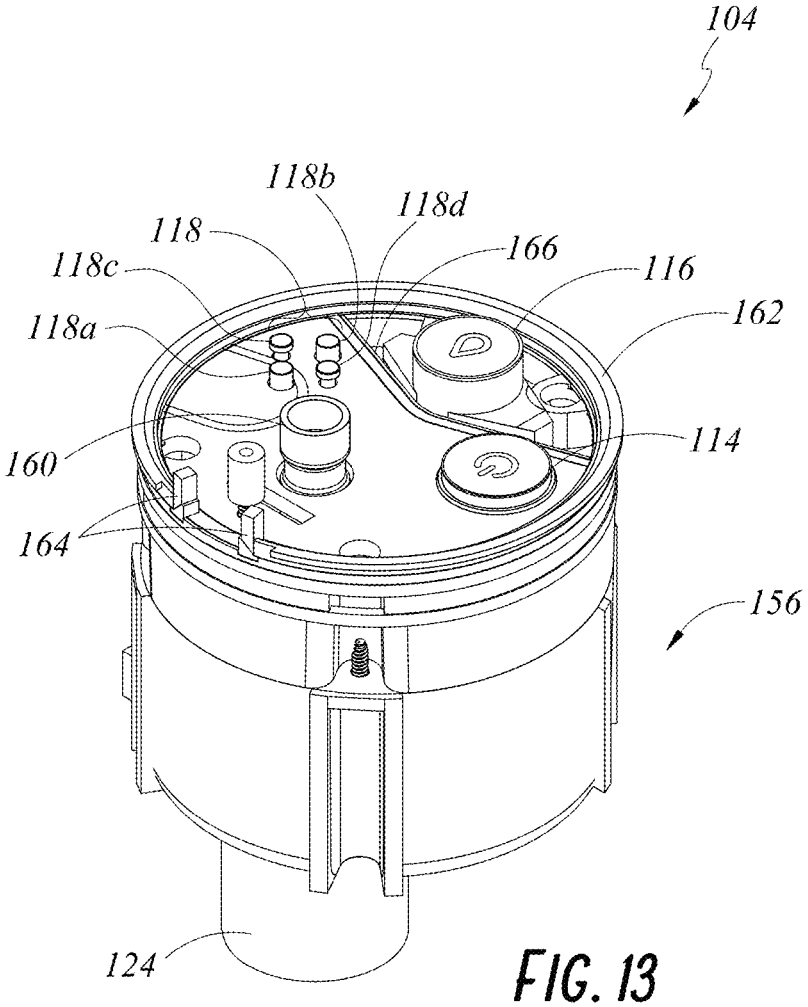
FIG. 13 illustrates a top perspective view of the fluid handling unit of FIG. 12 with a dispensing assembly and a cover removed.

FIG. 13 illustrates the fluid handling unit 104 with the cover 158 and discharge assembly 110 hidden for presentation purposes. As shown, the fluid handling unit 104 can include a conduit 160, which can connect with the discharge assembly 110. As discussed in more detail below, the conduit 160 can deliver a flow of soap (e.g., liquid, aerated, and/or foamed soap) to the discharge assembly 110 for dispensation.

1. Indicating Assembly

Some embodiments include visual indication features. For example, as illustrated in FIG. 13, the fluid handling unit 104 can include an indicating assembly configured to provide an indication of one or more status conditions to a user. In some embodiments, the indicating assembly includes a lighting assembly. The lighting assembly can include a light pipe 162 that is configured to receive, carry, and/or emit light from a light source (not shown). As illustrated in FIG. 13, in some embodiments, the light pipe 162 can be positioned around substantially the entire perimeter of the fluid handling unit 104. In some embodiments, the light pipe 162 is made of a generally transparent plastic material. Further examples and details regarding illumination with light pipes can be found in U.S. Patent Application Publication No. 2013/0235610, filed Mar. 1, 2013, the entirety of which is hereby incorporated by reference. Any structure, material, component, feature, method, or step described and/or illustrated in the '610 Publication can be used in combination with, or instead of, any structure, material, component, feature, method, or step described and/or illustrated in this specification.

The light pipe 162 can include an inlet portion 164, such as the illustrated generally axially extending projection. The inlet portion 164 can receive light from the light source, can carry the light around some or all of the length of the light pipe 162, and/or can emit the light out of the light pipe 162. As shown, in some embodiments, the light pipe 162 includes a plurality of inlet portions 164, such as two inlet portions 164 with a circumferential gap therebetween.

Certain embodiments include an inner light pipe 166, which can divide the area bounded by the light pipe 162 into a first area and a second area. For example, as shown in FIG. 13, the inner light pipe 166 can divide the area bounded by the light pipe 162 into an area around the coupling actuator 116 and an area around the power actuator 114 and/or the power supply 118. In some embodiments, the ratio of the first area to the second area is at least about: 0.1, 0.2, 0.3, 0.5, 1.0, 2.0, ratios between the aforementioned ratios, or other ratios. The inner light pipe 166 can be configured to receive light from the light pipe 162, to carry the light along some or all of the length of the inner light pipe 166, and/or to emit the light out of the inner light pipe 166 (e.g., generally upwardly).

As mentioned above, the light source can be configured to transmit light into the light pipe 162. In certain implementations, the light source is a light emitting diode. The light source can be configured to provide various colors of light (e.g., white, blue, green, yellow, and/or red) and/or various patterns of light (e.g., flashing on and off, gradually increasing in intensity and gradually decreasing in intensity, or otherwise). In some embodiments, the light source is part of the dispensing assembly 110.

In some implementations, the soap pump 100 is configured such that the indicating assembly can transmit an indication into the ambient environment. For example, some embodiments are configured to transmit an audible sound, such as a beep, chirp, or song. Certain embodiments are configured to transmit light into the ambient environment. For example, the light pipe 162 can be configured to transmit light out of the soap pump 100 through a gap between the outer housing 106 and the lid 108 (see FIG. 2). In various embodiments, the sound or light can provide an indication to a user. For example, sound or light can be provided during dispensation of foamed soap, which can confirm to a user that the soap pump 100 is operating. In some embodiments, the soap pump 100 is configured to transmit a certain color of light to indicate a status condition, such as red light to indicate that the amount of remaining soap and/or power is at or near a certain amount (e.g., less than about 10% remaining). In certain embodiments, the soap pump 100 is configured to provide an indication (e.g., a light or audible sound) for a prescribed period of time, such as a time associated with a recommended hand washing duration (e.g., at least about 20 seconds).

In some implementations, the soap pump 100 is configured to provide (e.g., in response to an input from a user) illumination of the area generally in the vicinity of the soap pump 100. This can assist a user in performing a task, such as navigating through and/or washing their hands in a darkened room. For example, the soap pump 100 can be configured to provide sufficient light to enable a user to find and operate plumbing fixtures in a bathroom at night. Certain embodiments include timer functionality, such as being configured to provide illumination for a certain amount of time (e.g., 30 minutes, 1 hour, 2 hours, etc.). In some implementations, the soap pump 100 provides generally continuous illumination. For example, the light source can be operated at a duty cycle such that the emitted light appears to a user to be uninterrupted. In various embodiments, the illumination of the light pipe 162 is controlled by an electronic control unit (ECU), which is described in further detail below.

2. Air Inlet Assembly

Figure 14:
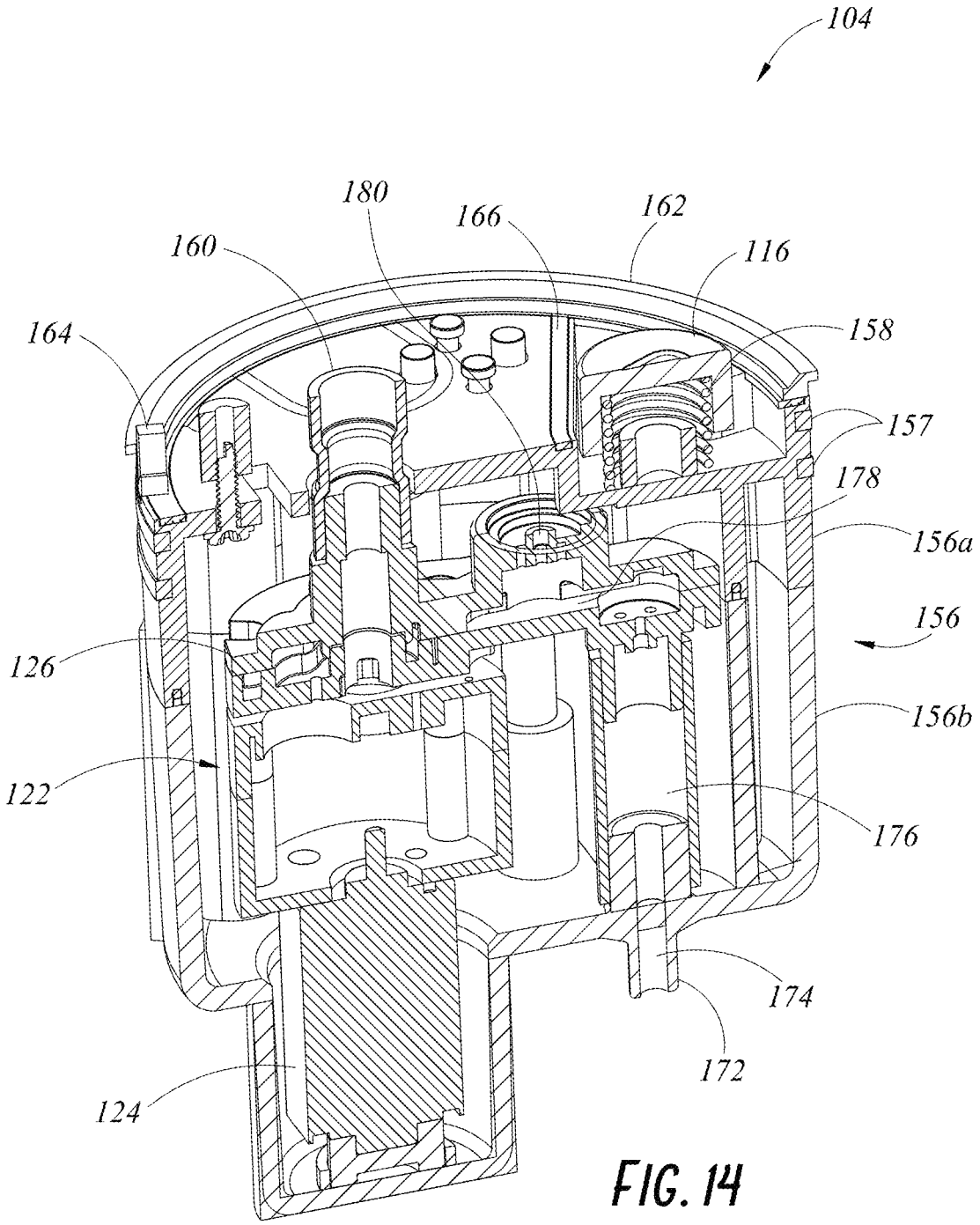
FIG. 14 illustrates an enlarged top perspective cross-sectional view of the fluid handling unit of FIG. 13.

As shown in the cross-sectional perspective view illustrated in FIG. 14, the casing 158 can include an engaging member, such as a generally downwardly extending projection 172 with a passage 174. As discussed above, in some embodiments, the projection 172 can engage with (e.g., be inserted into) the outlet 138 of the fluid storage unit 102. In some implementations, engagement between the projection 172 and the outlet 138 opens a flow path between the fluid storage unit 102 and the fluid handling unit 104. For example, the reservoir 120 can be in fluid communication with an inlet chamber 176 of the fluid handling unit 104, thereby allowing liquid soap to flow into the inlet chamber 176. In some embodiments, the liquid soap flows generally vertically through the inlet chamber 176. As shown, in certain implementations, a longitudinal axis of the inlet chamber 176 is generally parallel with a longitudinal axis of the conduit 160. In some embodiments, the longitudinal axis of the inlet chamber 176 and the conduit 160 are about collinear. In some variants, the longitudinal axis of the inlet chamber 176 is offset from (e.g., not collinear with and/or spaced generally horizontally apart from) the longitudinal axis of the conduit 160.

In some embodiments, the inlet chamber 176 connects with an aerating chamber 178. For example, the inlet chamber 176 can fluidly connect with the aerating chamber 178 via a bend. In some embodiments, the bend changes the direction of the flow of the soap, such as from flowing generally vertically to flowing generally horizontally. As shown, in some embodiments, the bend is about 90°. In some variants, the bend is greater than or equal to about 85° and/or less than or equal to about 95°. Certain embodiments are configured such that soap flows through the aerating chamber 178 generally horizontally and through the inlet chamber 176 and/or the conduit 160 generally vertically.

The aerating chamber 178 can include an air inlet 180. The air inlet 180 can be configured to allow air (e.g., ambient air) to enter the aerating chamber 178. In some embodiments, the air inlet 180 can include a one-way valve, such as an umbrella valve. In certain variants, the aerating chamber 178 includes a venturi tube, which can aid in drawing air into the aerating chamber 178 via the air inlet 180.

In various implementations, air from the air inlet 180 mixes with the liquid soap to form aerated soap. In some embodiments, the aerated soap is predominately liquid soap, with air bubbles mixed in. For example, the ratio of air to liquid soap can be less than or equal to about: 0.01, 0.05, 0.10, 0.15, 0.20, 0.30, 0.50, ratios between the aforementioned ratios, or other ratios. In certain variants, the ratio of air to liquid soap is about: 1:5, 1:7, 1:9, ratios between the aforementioned ratios, or other ratios. In some embodiments, the aerated soap is predominately air. For example, the ratio of air to liquid soap can be greater than or equal to about: 1.01, 1.10, 1.20, 1.5, 2.0, 3.0, 4.0, 5.0, ratios between the aforementioned ratios, or other ratios. In certain variants, the mixing of the air with the liquid soap forms foamed soap. Some embodiments are configured to vary the ratio of air to liquid soap, such as with a valve configured to adjust the amount of air and/or liquid soap that enters the aerating chamber 178. In some variants, the valve is controlled by the ECU.

3. Pumping Assembly

FIGS. 15-23 illustrate an example of the pumping assembly 122. As mentioned above, the pumping assembly 122 can include a motor 124 and a pumping unit 126. The motor 124 can be configured to drive the pumping unit 126. In some embodiments, such driving can withdraw liquid soap from the reservoir 120, draw air into the aerating chamber 178 via the air inlet 180, and/or encourage liquid and/or aerated soap into the pumping unit 126. In some embodiments, such driving can encourage soap (e.g., liquid, aerated, and/or foamed) out of the pumping unit 126 and into the dispensing assembly 110 for dispensation out of the soap pump 100. In various embodiments, driving of the motor 124 results in conversion of the liquid and/or aerated soap into foamed soap, such as by encouraging the liquid and/or aerated soap through a foaming unit (e.g., a screen), as is discussed in more detail below.

In certain embodiments, the motor 124 is an AC or DC electric motor, stepper motor, server motor, solenoid, stepper solenoid, or any other type of actuator. In some implementations, the motor 124 can be connected to the pumping unit 126 with a force transmitter device, such as a gear train or a flexible transmitter assembly (e.g., a belt, chain, or otherwise). The motor 124 can be connected with the power supply 118 such that the motor 124 can receive electric power from the power supply 118. For example, in response to a call to dispense soap (e.g., from a sensor and/or a user input device), the ECU can instruct that electric power from the power supply 118 be provided to the motor 124 to drive the pumping unit 126 to dispense foamed soap from the soap pump 100.

Figure 15:
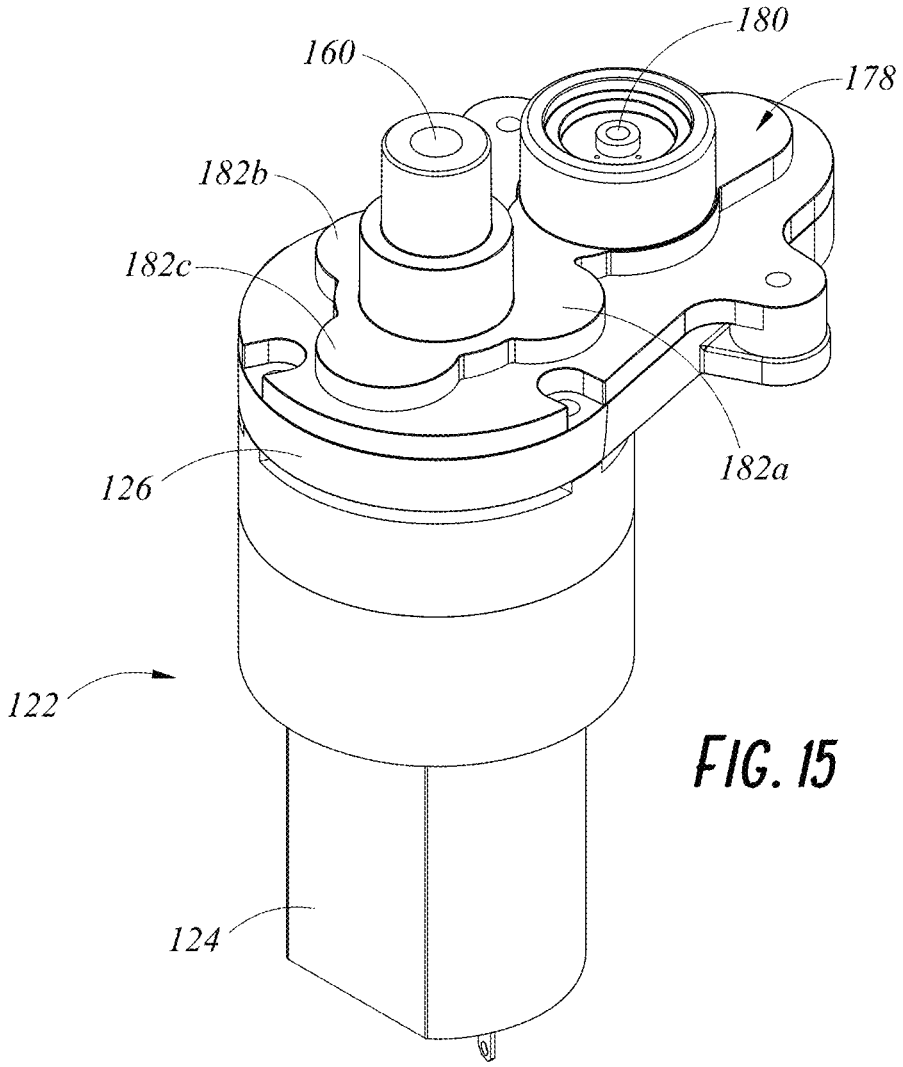
FIG. 15 illustrates an enlarged top perspective view of a pumping assembly of the fluid handling unit of FIG. 12.
Figure 16:
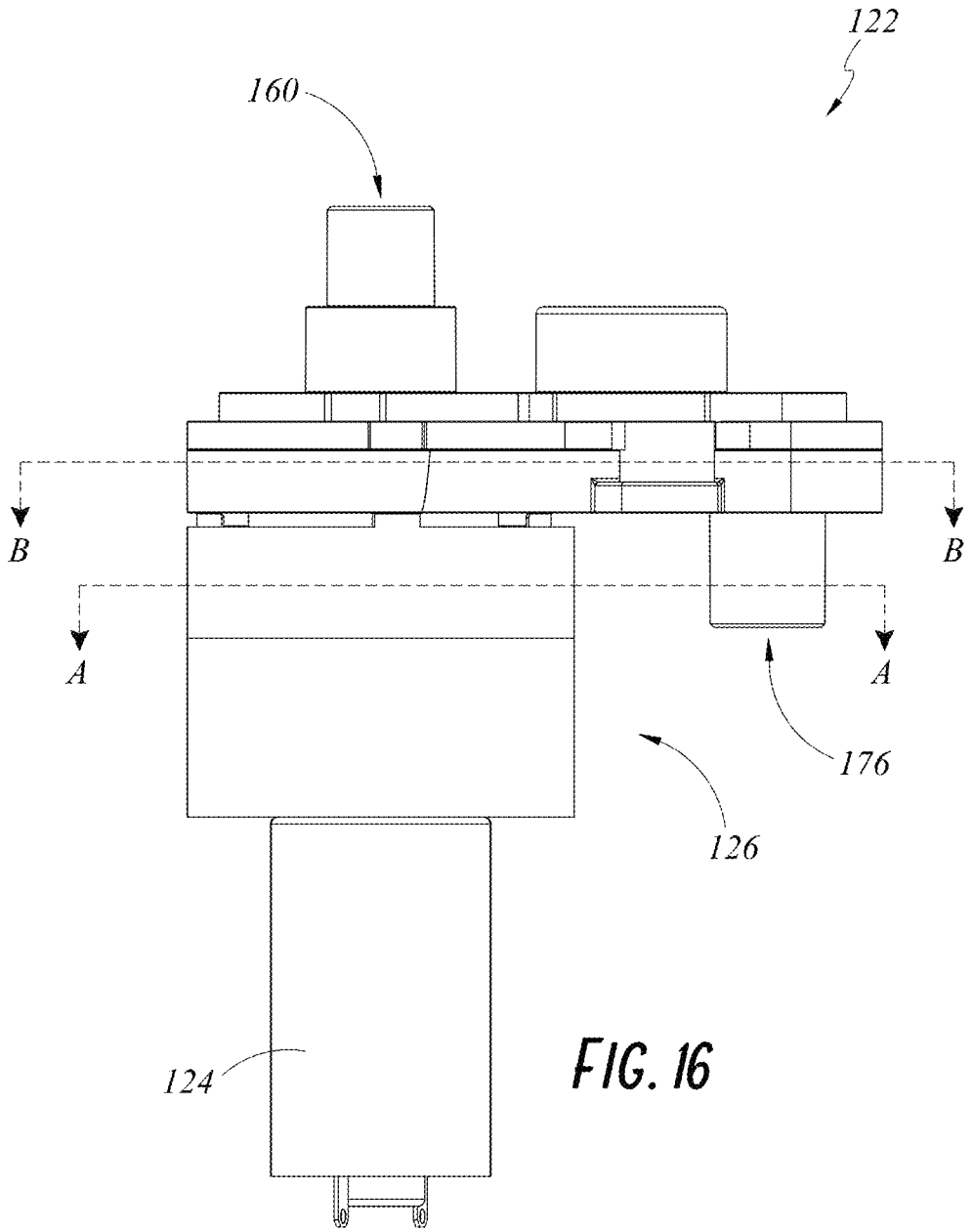
FIG. 16 illustrates a front elevation view of the pumping assembly of FIG. 15.
Figure 17:
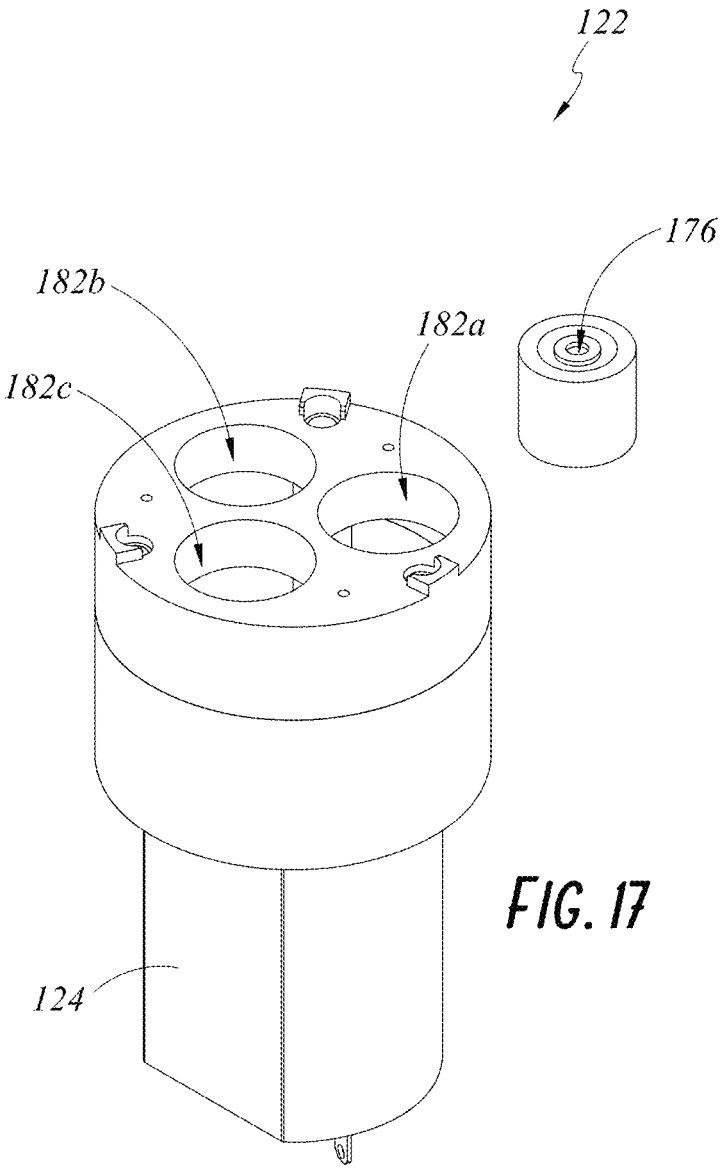
FIGS. 17 and 18 illustrate perspective and top cross-sectional views of the pumping assembly of FIG. 16 along the line A-A.
Figure 18:
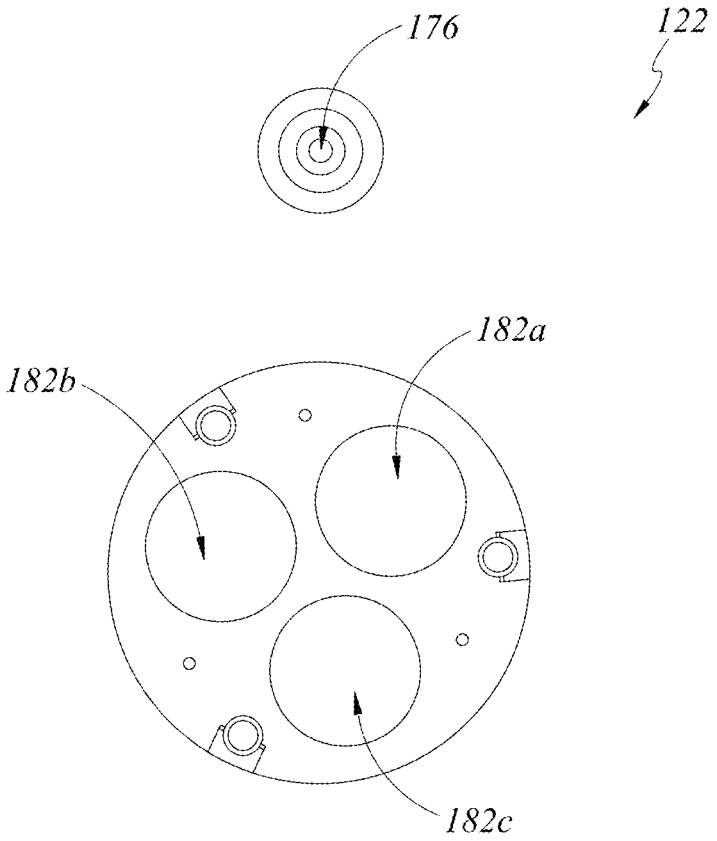
Figure 19:
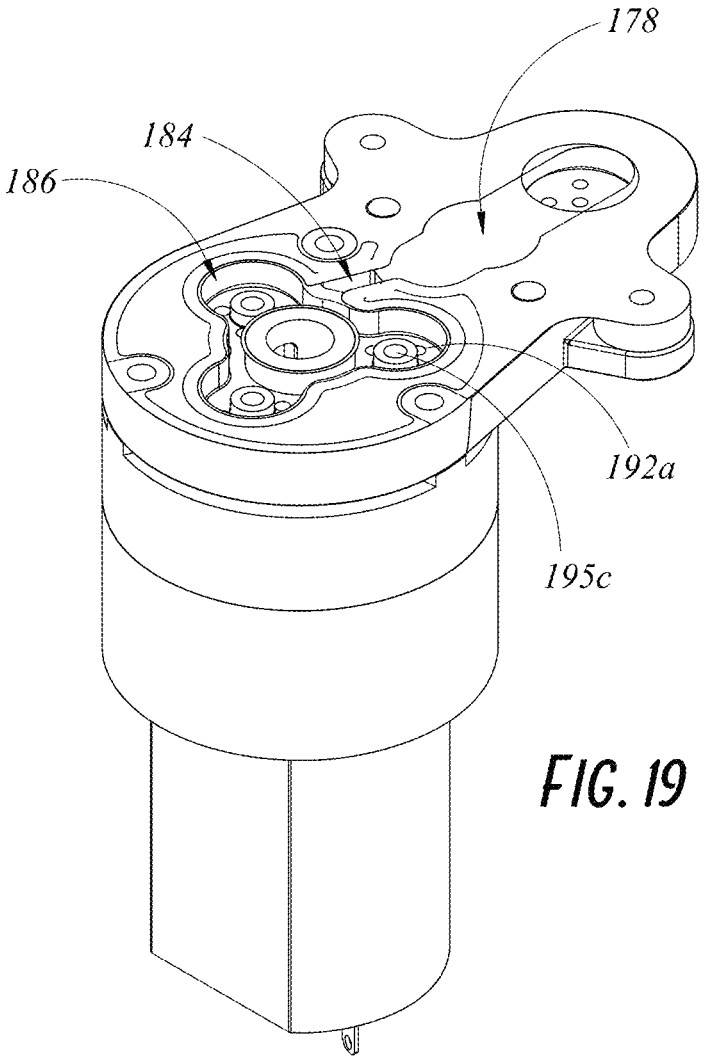
FIGS. 19 and 20 illustrate perspective and top cross-sectional views of the pumping assembly of FIG. 16 along the line B-B.

As shown in FIG. 15, the pumping assembly 122 can include the pumping unit 126, which can be configured to encourage a flow of soap through the soap pump 100. In some embodiments, the pumping unit 126 includes a diaphragm pump, peristaltic pump, or other type of pump. In some embodiments, the pumping unit 126 includes a rolling pump or roller pump. As described in more detail below, the pumping unit 126 can include one or more compartments each with an associated resilient member that is configured to increase and decrease the volume of portions inside the pumping unit 126 to alternatingly draw-in and expel-out soap.

As illustrated in FIGS. 16-20, the pumping assembly 122 can include a plurality of compartments, such as a first compartment 182*a*, second compartment 182*b*, and third compartment 182*c*. Certain variants include one, two, four, five, or more compartments. As shown, in some implementations, the compartments 182*a*-182*c* extend radially outward from and/or are circumferentially spaced around the conduit 160. For example, the compartments can be about equally circumferentially spaced around the conduit 160, such as three compartments spaced about 120° apart, four compartments spaced about 90° apart, or otherwise. In some implementations, the compartments 182*a*-182*c* are generally cylindrical or generally hemispherical.

Figure 21:
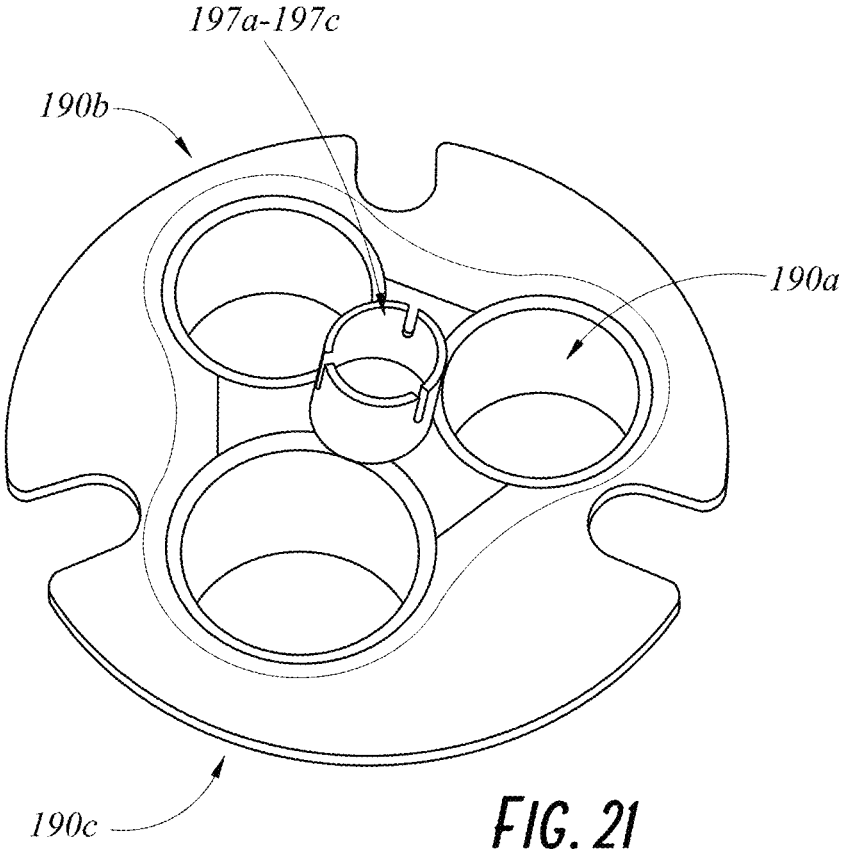
FIGS. 21 and 22 show top and bottom perspective views of a diaphragm unit of the pumping assembly of FIG. 15.
Figure 22:
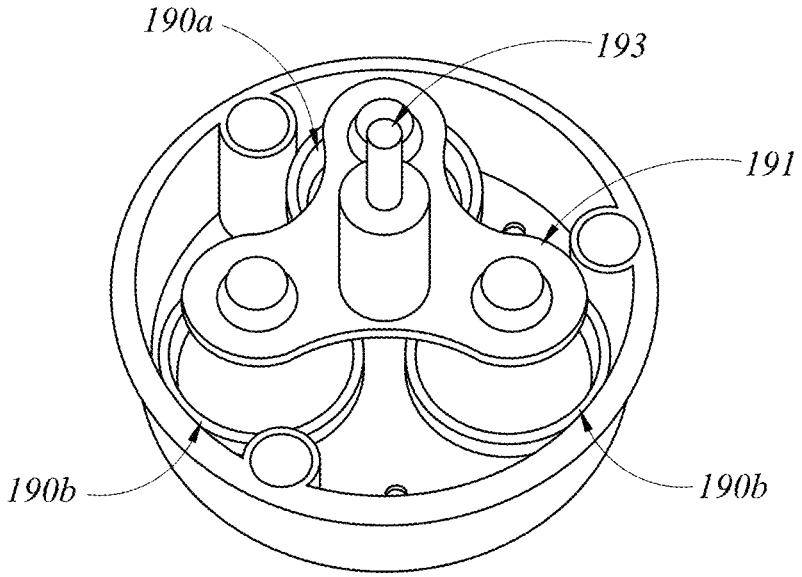

As shown in FIGS. 21 and 22, the pumping assembly 122 can include a diaphragm unit, such as a rubber or plastic gasket with movable membranes. In some embodiments, the diaphragm unit includes a plurality of resilient members, such as one resilient member for each of the compartments. For example, as shown, the diaphragm unit can include diaphragms 190*a*-190*c* and each of the diaphragms 190*a*-190*c* can be associated with a respective one of the compartments 182*a*-182*c*. In some embodiments, the diaphragms 190*a*-190*c* are located in a lower or lowermost-most portion of the respective compartment. For example, the diaphragms 190*a*-190*c* can form a bottom wall of the compartments 182*a*-182*c*. As is also shown in FIG. 21, some embodiments include outlet one-way valves, as are discussed in more detail below.

In certain implementations, diaphragm unit includes a tilting member 191. The tilting member 191 can be connected with and/or engage the diaphragms 190*a*-190*c*. For example, the diaphragms 190*a*-190*c* can each have an extension portion (e.g., a downwardly extending leg) that connects with a lobe of the tilting member 191. As shown, the tilting member 191 can connect with a shaft 193. As discussed below, in various embodiments, the tilting member 191 is configured to tilt, pivot, and/or rock as the shaft 193 is moved.

Figure 23:
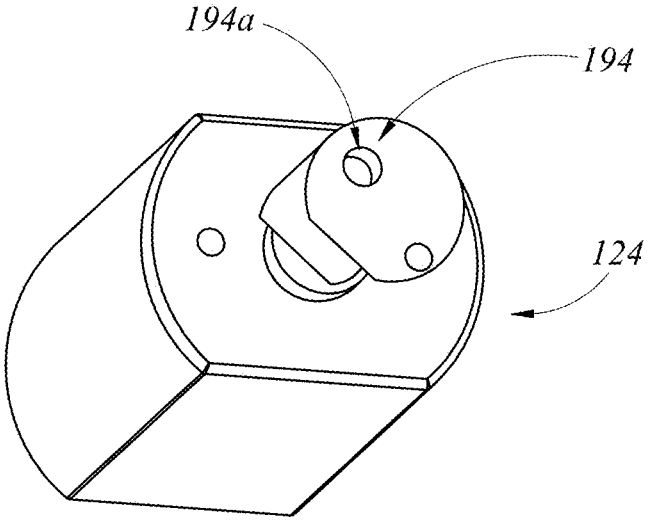
FIG. 23 shows a top perspective view of a motor and an actuation member of the pumping assembly of FIG. 15.

The shaft 193 can be connected with an actuation member 194, which can be connected with the motor 124. In some embodiments, the actuation member 194 is configured to rotate about an output shaft axis of the motor 124. As shown in FIG. 23, the actuation member 194 can include an arm, such as a cantilevered element that extends radially outward from a drive shaft of the motor 124. In some implementations, the actuation member 194 includes a recess 194*a* that is configured to receive the shaft 193. As shown, the recess 194*a* can be radially offset from the output shaft axis of the motor 124.

In some embodiments, the motor 124 is configured to rotate the actuation member 194, which in turn rotates the shaft 193. Because of the radial offset of the recess 194*a*, the shaft 193 can be moved in such a way that a tip of the shaft rotates in a generally circular path (e.g., around the output shaft axis of the motor 124). In some implementations, movement of the shaft 193 causes the tilting member 191 to move, such as in a circumferential tilting, pivoting, and/or rocking manner. This can result in the lobes of the tilting member 191 actuating (e.g., pushing and pulling) on the extension portions of the diaphragms 190*a*-190*c*, thereby actuating (e.g., pushing, pulling, deforming, reshaping, etc.) one or more of the diaphragms 190*a*-190*c*.

In some embodiments, the tilting member 191 can actuate the diaphragms 190*a*-190*c* between the first state (e.g., convex state) and the second state (e.g., concave state). In certain implementations, rocking motion of the tilting member 191 can cause repeated compression and release of the diaphragms 190*a*-190*c*. This sequentially can change the volume of the compartments 182*a*-182*c* and/or can encourage a flow of soap into and out of the compartments 182*a*-182*c*, as is described in more detail below.

In some embodiments, the diaphragms 190*a*-190*c* can pass through an intermediate state between the first and second states. The intermediate state can be a less convex state than the first state or a less concave state than the second state. In some variants, the intermediate state is a generally planar state.

The state of the diaphragms 190*a*-190*c* can be related to the position of the tilting member 191. For example, in some embodiments, when the tilting member 191 is in a first position, the first diaphragm 190*a* can be convex, the second diaphragm 190*b* can be in an intermediate position, and the third diaphragm 190*c* can be concave. In a second position of the tilting member 191, the first diaphragm 190*a* can be concave, the second diaphragm 190*b* can be convex, and the third diaphragm 190*c* can be in an intermediate position. And, when the tilting member 191 is in a third position, the first diaphragm 190*a* can be in an intermediate position, the second diaphragm 190*b* can be concave, and the third diaphragm 190*c* can be convex.

Figure 20:
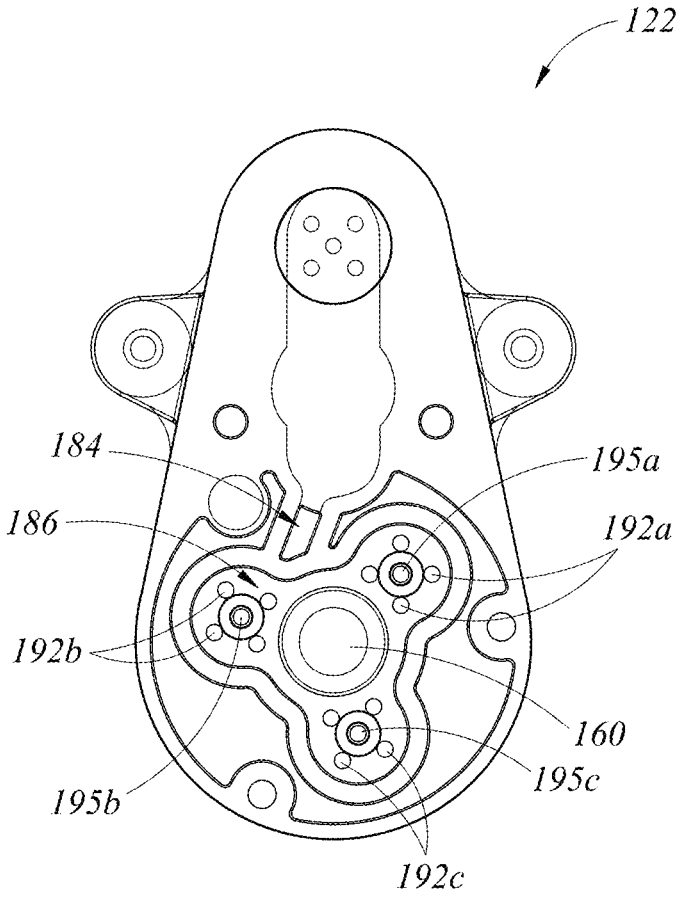

In various embodiments, the pumping unit 126 is connected with the aerating chamber 178. For example, each of the compartments 182*a*-182*c* can be in fluid communication with the aerating chamber 178, such as by an inlet passage 184, as shown in FIG. 20. In some embodiments, the inlet passage 184 is connected with a staging chamber 186, such as the illustrated chamber that is positioned above the compartments 182*a*-182*c*. In certain embodiments, the staging chamber 186 is positioned between an outer wall of the conduit 160 and an inner wall of the pumping assembly 122.

Some embodiments are configured to enable liquid and/or aerated soap to flow (e.g., be drawn) into the compartments 182*a*-182*c*. For example, each of the compartments 182*a*-182*c* can be connected with the staging chamber 186 via an inlet passage 192*a*-192*c*. As shown in FIG. 20, certain embodiments include a plurality of inlet passages 192*a*-192*c*, such as each compartments 182*a*-182*c* being connected to the staging chamber 186 by two, three, four, five, six, or more inlet passages. Some embodiments include features to reduce the chance of backflow of the soap. For example, each of the compartments 182*a*-182*c* can include an associated inlet one-way valve, such as an umbrella valve, duckbill valve, or other type of valve. The inlet one-way valve can be configured to inhibit or prevent liquid from flowing from the compartments 182*a*-182*c* into the staging chamber 186.

In some embodiments, the pumping unit 126 is connected with the conduit 160. For example, each of the compartments 182*a*-182*c* can be in fluid communication with the conduit 160, such as by an outlet passage 195*a*-195*c*. In certain embodiments, less than all (e.g., one or two) of the compartments 182*a*-182*c* are in fluid communication with the conduit 160 at a time. Certain embodiments are configured to enable a flow of soap (e.g., liquid, aerated, and/or foamed soap) to be provided from one or more of the compartments 182*a*-182*c* to the discharge assembly 110 via the conduit 160.

As mentioned above, some embodiments include outlet one-way valves 197*a*-197*c*, such as a flap valve, umbrella valve, duckbill valve, or other type of valve. The outlet one-way valves 197*a*-197*c* can each be associated with a respective one of the compartments 182*a*-182*c*. The outlet one-way valves 197*a*-197*c* can be configured to inhibit or prevent liquid from flowing from the conduit 160 back into the respective compartment. As shown in FIG. 21, in certain implementations, the outlet one-way valves 197*a*-197*c* each include a deflectable member, such as a flap. In some embodiments, the flaps can be received in corresponding notches in a body of the pump assembly 122. Each flap can be configured to open (e.g., deflect). For example, when the flap's associated compartment is expelling soap, the flap can open (e.g., be deflected by the flow of soap) to permit the soap to flow to the conduit 160. In some embodiments, only one flap is open at a time.

Figure 24A:
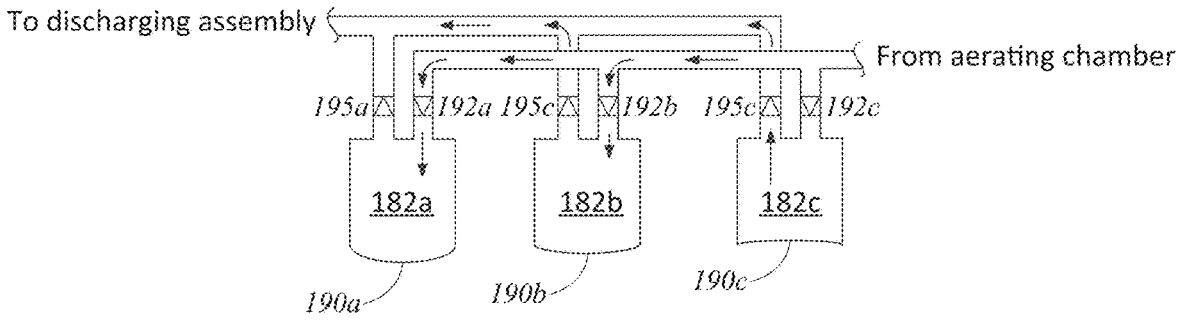
FIGS. 24A-24C schematically illustrate certain operational states of the pumping assembly of FIG. 15.
Figure 24B:
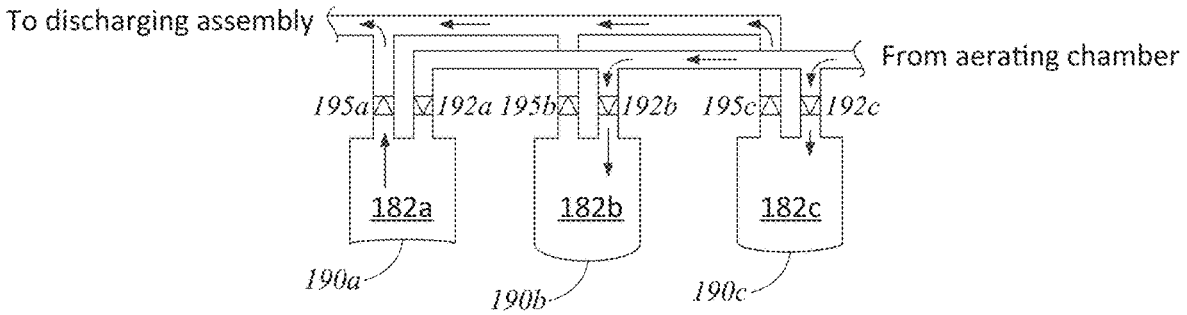
Figure 24C:
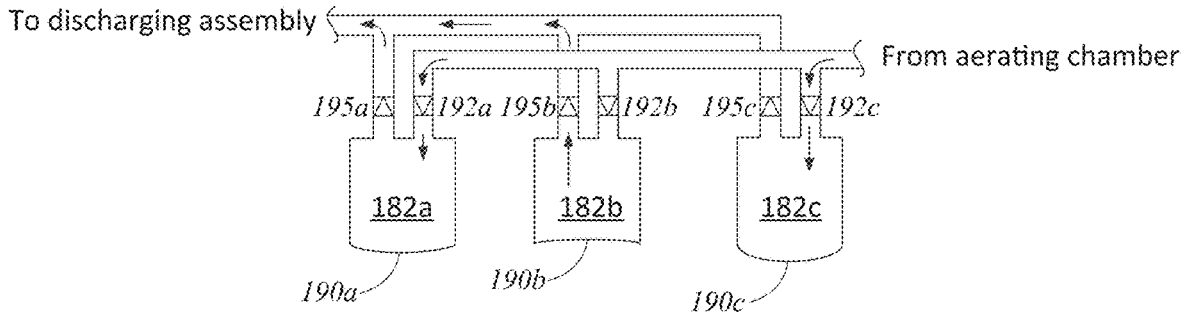

Various operational states of the pumping unit 126 are schematically illustrated in FIGS. 24A-24C. As shown, in various states, the diaphragms 190*a*-190*c* can be actuated (e.g., compressed and released, pushed and pulled, moved back and forth, or otherwise actuated) between a first state and a second state. In some implementations, in the first state, the diaphragms extend downward and/or in a direction generally away from the top of their respective compartment. For example, in the first state, the diaphragms can have a convex shape (see compartment 182*a* in FIG. 24A). In various embodiments, the first state is a free and/or unactuated state of the diaphragm.

In certain embodiments, in the second state, the diaphragms extend upward and/or in a direction generally toward the top of their respective compartment. For example, in the second state, the diaphragms can have a concave shape (see compartment 182*c* in FIG. 24A). In certain variants, in the second state, the diaphragms are generally planar. In various embodiments, the second state is an actuated state of the diaphragms, as will be discussed in further detail below.

In some embodiments, the change in shape of a particular diaphragm results in a change in the volume of their diaphragm's associated compartment. For example, each compartment can have a greater volume when the associated diaphragm 190 is in the first state than when the diaphragm is in the second state. This can be because in the convex shape the diaphragm extends out of the compartment and thus add volume, while in the concave shape the diaphragm extends into the compartment and thus subtracts volume. In some embodiments, the ratio of the volume of the compartment in the first state to the volume of the compartment in the second state is at least about: 1.01, 1.05, 1.1, 1.2, 1.3, ratios between the aforementioned ratios, and other ratios.

In various embodiments, the movement of a diaphragm can encourage a flow of soap out of a respective compartment. For example, in some implementations, when the diaphragm moves from the first state to the second state, the volume of the respective compartment decreases (e.g., because the diaphragm changes from a convex shape to a concave or planar shape). This can reduce the volume in the compartment, which can increase the pressure in the compartment, which in turn can encourage soap to flow out of the compartment. For example, soap can be expelled into and through the outlet passage 195*a*-195*c*. As previously discussed, the outlet one-way valve can inhibit or prevent backflow of the soap.

Similarly, in some implementations, the movement of a diaphragm can encourage a flow of soap into a respective compartment. For example, in some implementations, when the diaphragm moves from the second state to the first state, the volume of the respective compartment increases (e.g., because the diaphragm changes from a concave or planar shape to a convex shape). This can increase the volume in the compartment, which can decrease the pressure in the compartment, which in turn can encourage soap to flow into the compartment. For example, soap can be drawn-in from the inlet passage 184 and/or the staging chamber 186. As previously discussed, the inlet one-way valve can inhibit or prevent backflow of the soap.

In various embodiments, the diaphragms 190*a*-190*c* can move back and forth between the first and second states. This can alternatingly increase and decrease the volume of the respective compartments 182*a*-182*c* and/or alternatingly draw soap into and discharge soap from the compartments 182*a*-182*c*. Thus, in some embodiments, the movement of the diaphragms 190*a*-190*c* can produce a flow of soap from the reservoir 120 to the discharge assembly 110.

FIGS. 24A-24C further illustrate example operational states of the pumping unit 126, such as example movements of the diaphragms 190*a*-190*c* as well as the flow of soap into and out of the compartments 182*a*-182*c*. In FIG. 24A, the diaphragm of the compartment 182*a* is in the first state, the diaphragm of the compartment 182*b* is in the second state and the diaphragm of the compartment 182*c* is in an intermediate state. For example, this can be because the position of the tilting member 191 is pulling the compartments 182*a*, 182*b* and pushing the compartment 182*c*. As shown, soap can be drawn into the compartments 182*a*, 182*b* and can be encouraged out of the compartment 182*c*. As also shown, in some embodiments, the compartment in the intermediate state can be configured to slightly draw-in soap (e.g., less than the draw of the compartment in the first state). In some variants, the compartment in the intermediate state can be configured to slightly expel soap (e.g., less than the expulsion of the compartment in the second state) or substantially neither draw nor expel soap.

In the example illustrated in FIG. 24B, the diaphragm of the compartment 182*b* is in the first state, the diaphragm 182*c* is in the intermediate state, and the diaphragm of the compartment 182*a* is in the second state. As shown, soap can be drawn into the compartments 182*b*, 182*c* and can be encouraged out of the compartment 182*a*.

In the example of FIG. 24C, the diaphragm of the compartment 182*c* is in the first state, the diaphragm 182*a* is in the intermediate state, and the diaphragm of the compartment 182*b* is in the second state. As shown, soap can be drawn into the compartments 182*a*, 182*c* and can be encouraged out of the compartment 182*b*.

4. Dispensing Assembly

Figure 25:
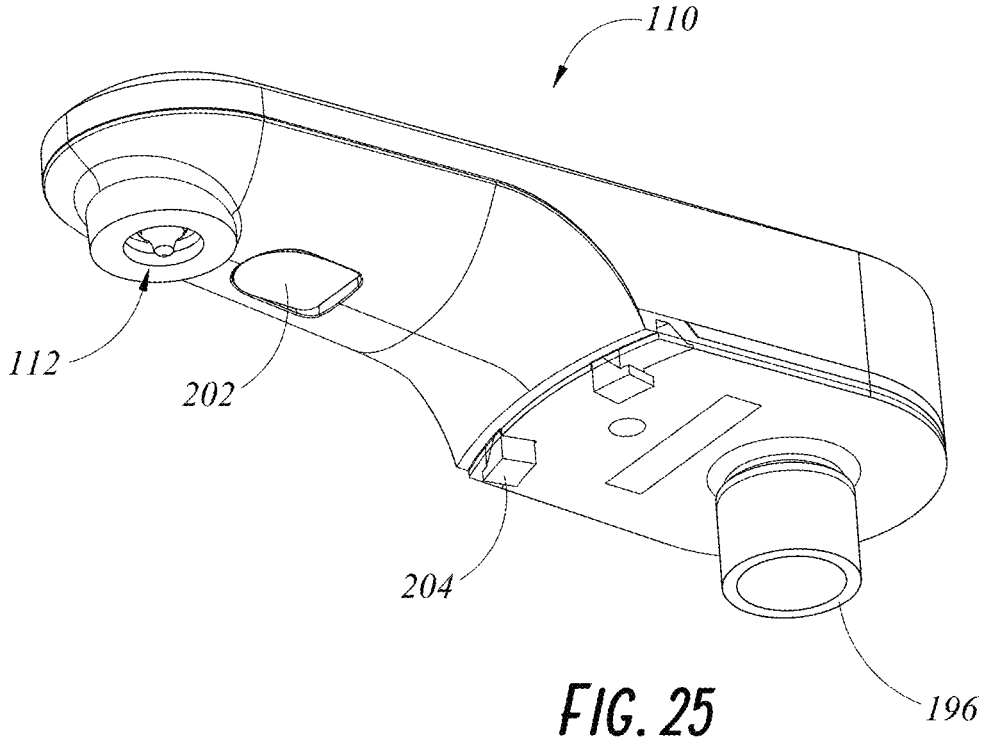
FIG. 25 illustrates a bottom perspective view of a dispensing assembly of the fluid handling unit of FIG. 12.
Figure 26:
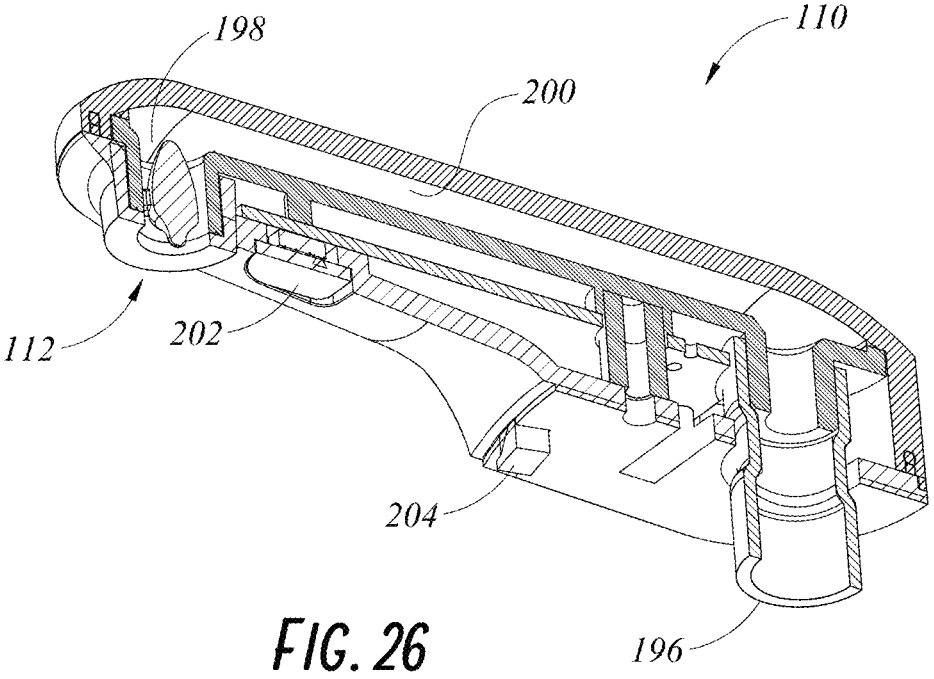
FIG. 26 illustrates a perspective cross-sectional view of the dispensing assembly of FIG. 25.

FIGS. 25-30 illustrate an example of the dispensing assembly 110. As shown, the dispensing assembly 110 can include a conduit 196. The conduit 196 of the dispensing assembly 110 can engage (e.g., receive) the conduit 160 of the pumping assembly 122, thereby providing a flow path for soap from the pumping assembly 122 into the dispensing assembly 110. As illustrated in FIGS. 25 and 26, the dispensing assembly 110 can include a foaming unit 198, passage 200, sensor device 202, and/or a light emitting portion 204, each of which are discussed in more detail below.

As previously mentioned, the dispensing assembly 110 can include the nozzle 112, through which foamed soap is dispensed. The nozzle 112 can be in fluid communication with the foaming unit 198 by the passage 200, such as a generally horizontally extending passage. In some embodiments, the passage 200 is pitched, such as being lower at the foaming unit 198 than at the nozzle 112. This can encourage non-dispensed soap to flow back into the foaming unit 198 and/or conduit 196, which can reduce the chance of soap unintentionally dripping from the nozzle 112.

Figure 27:
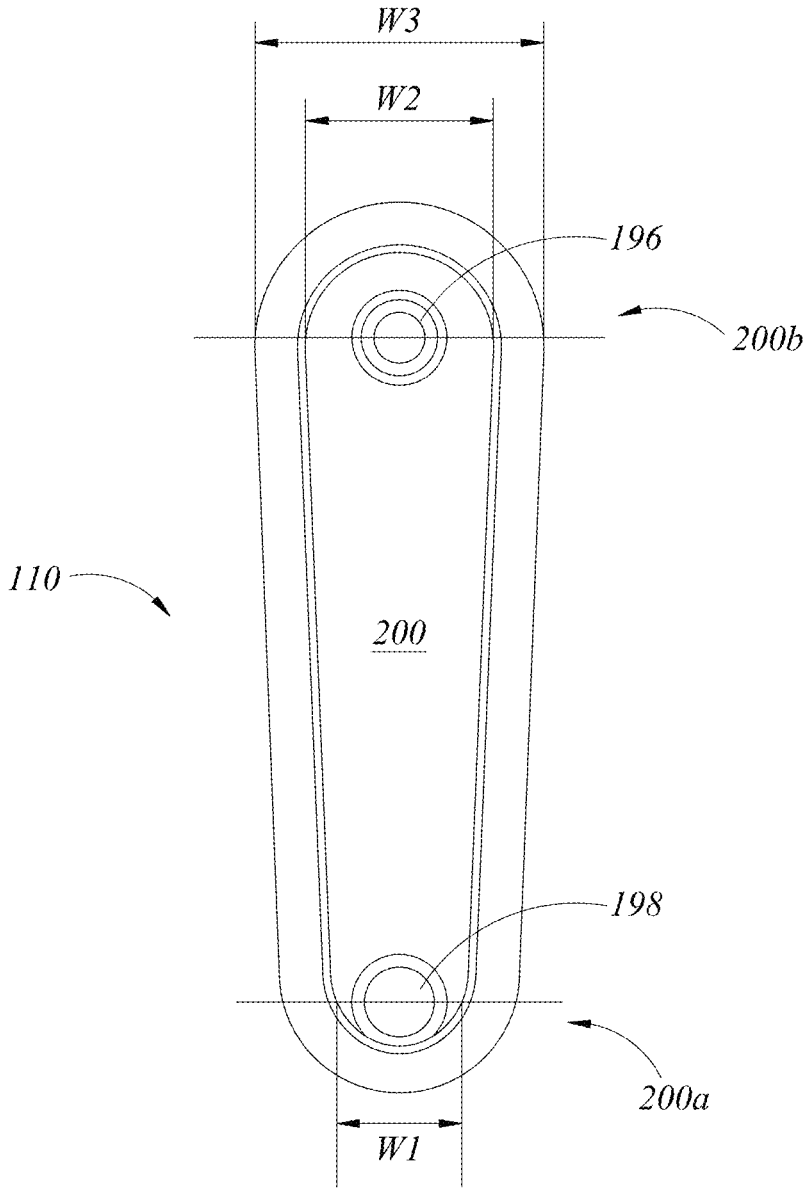
FIG. 27 illustrates a top cross-sectional view of the dispensing assembly of FIG. 25.
Figure 28:
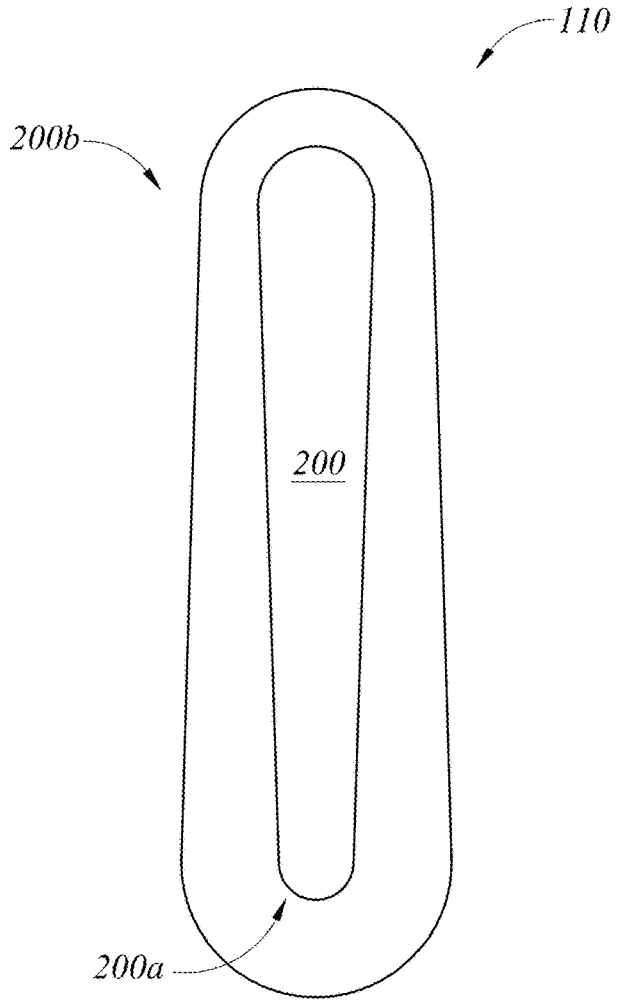
FIGS. 28 and 29 show top and bottom plan views of embodiments of a dispensing assembly with a narrow passage.
Figure 29:
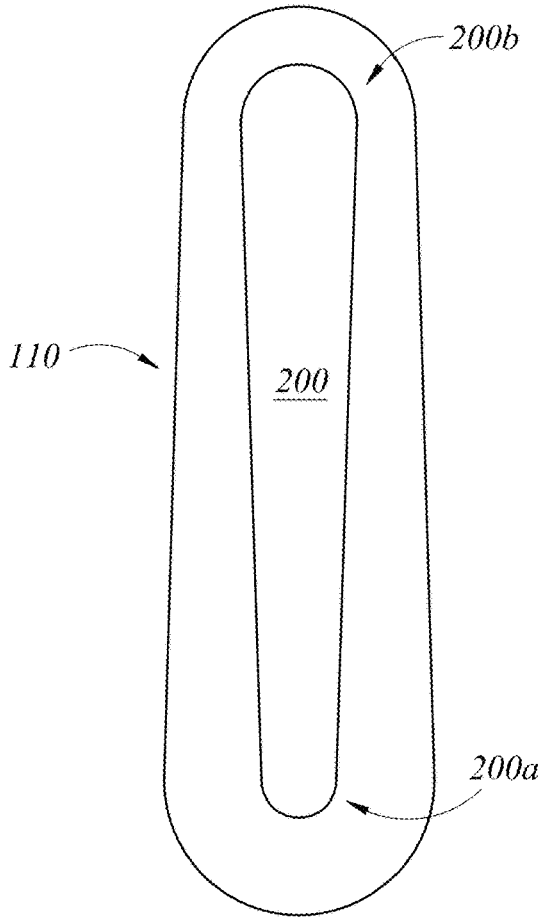

As shown in FIGS. 27-29, the passage 200 can have a variable width. For example, the passage 200 can taper. As illustrated, in certain embodiments, the passage 200 is narrower at a first end 200*a* (e.g., the end through which soap enters the passage 200) than at a second end 200*b* (e.g., the end through which soap exits the passage 200). In comparison to a passage 200 with a constant width, the passage 200 with a wider second end 200*b* can allow the use of a larger foaming unit 198 (e.g., screen or mesh). This can provide a larger area of contact between the soap and the foaming unit, which can result in an increase in the quantity and quality of the foamed soap. In some embodiments, because the foaming unit 198 can be an obstruction in the flow path of the soap, the foaming unit 198 can create a backpressure. In some embodiments, the increased size of the foaming unit 198 can increase the backpressure, which in turn can provide a better quality of foam.

In certain implementations, the ratio of the width W2 to the width W1 is at least about: 1.2, 1.5, 1.8, 2.0, 2.2, 2.5, ratios between the aforementioned ratios, or other ratios. In some variants, a width W1 of the passage 200 can be substantially less than a maximum or nominal outer width W3 of the dispensing assembly. In some implementations, the ratio of the width W2 to the width W3 is at less than or equal to about: 0.1, 0.2, 0.3, 0.4, 0.6, 0.8, ratios between the aforementioned ratios, or other ratios. In some embodiments, the passage 200 has a variable cross-sectional area (e.g., lateral width and vertical height), such as a cross-section that increases along it length (e.g., in a downstream direction). In some variants, the passage 200 is generally straight, untapered, and/or has a generally constant cross-sectional area.

In some embodiments, the passage 200 is a narrow channel in the dispensing assembly 110, such as is shown in FIGS. 23A and 23B. In some variants, the passage 200 is substantially narrower than it is long. For example, the ratio of the longitudinal length of the passage 200 to the width W1 can be at least about: 5, 8, 10, 12, 14, 16, ratios between the aforementioned ratios, or other ratios. In certain implementations, the passage 200 has a volume that is substantially less than a volume of the dispensing assembly 110. In some embodiments, the volume of the passage 200 is less than or equal to about 20% of the volume of the dispensing assembly 110. A passage 200 that is relatively narrow and/or that has a relatively small volume can facilitate priming of the soap pump 100. This can be because, in certain embodiments, filling the passage 200 is a prerequisite to dispensing soap through the nozzle 112, so a smaller volume of the passage 200 reduces the amount of soap needed to fill the passage 200 and/or the time needed to fill the passage 200. Similarly, in some embodiments, a passage 200 that is relatively narrow and/or that has a relatively small volume can reduce the amount of air in the passage that is to be displaced (e.g., ejected from the dispensing assembly 110) so that the soap can fill the passage 200, and thus prime the soap pump 100.

The nozzle 112 can be positioned on a portion of the dispensing assembly 110 that extends outward from (e.g., is cantilevered from) an upper portion of the housing 106. This can make it more convenient for a user to place a hand or other body part under the nozzle 112 to receive a quantity of foamed soap. In some embodiments, the nozzle 112 is configured to reduce drips. For example, the nozzle 112 can include a valve, such as a pin valve or duckbill valve.

Figure 30:
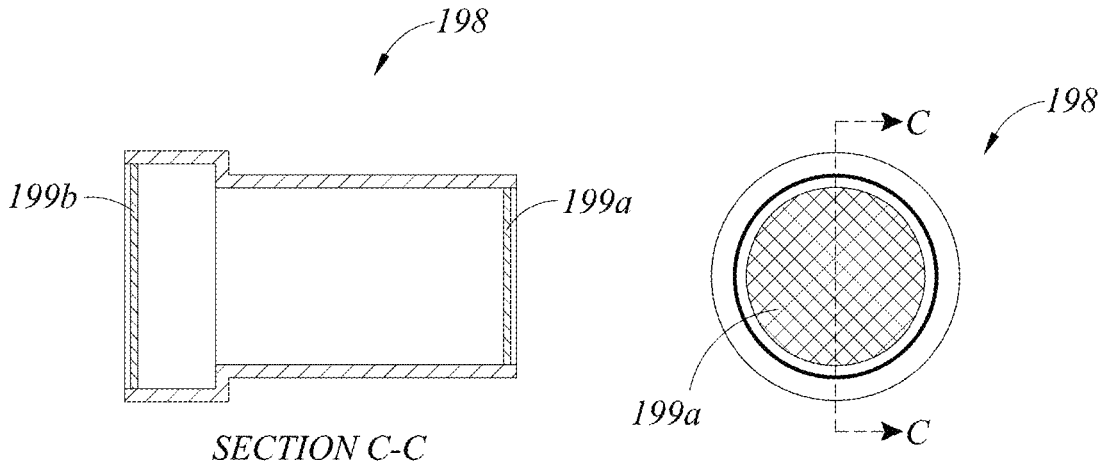
FIG. 30 illustrates front and cross-sectional views of a foaming unit of the dispensing assembly of FIG. 25.

As indicated above, the dispensing assembly 110 can include a foaming unit 198, such as is shown in FIG. 30. The foaming unit 198 can be configured to convert the liquid and/or aerated soap from the pumping assembly 122 into foamed soap. In some embodiments, the foaming unit 198 includes active and/or moving components, such as an impeller. In some embodiments, the foaming unit 198 includes passive and/or moving components, such as a screen or a venturi tube.

In various embodiments, the foaming unit 198 includes a porous barrier, such as a screen (also called a mesh) in the flow path of the soap. The screen can be configured to convert liquid and/or aerated soap into foamed soap. For example, in some embodiments, as liquid and/or aerated soap passes through the screen, the pressure in the liquid and/or aerated soap can change (e.g., decrease), which can cause the soap to convert into foamed soap. Certain embodiments include a vent (not shown) configured to allow air to enter the foaming unit 198, which can aid in producing foamed soap. The screen can be made of a corrosion-resistant material, such as plastic, aluminum, stainless steel, or otherwise As shown in FIG. 30, certain embodiments include a plurality of screens, such as two screens 199*a*, 199*b* spaced apart from each other. In some implementations, the first screen (e.g., a mesh that is upstream and/or is closer to the soap entry point in the dispenser assembly 110) has at least about 150 holes, has a pitch of about at least 150, and/or has at least about 150 holes per unit of area, such as about 150 holes/cm$^2$. In certain embodiments, the second screen (e.g., a mesh that is downstream and/or is closer to the soap exit point in the dispenser assembly 110) has more holes in total and/or per unit area than the first screen. For example, in certain embodiments, the second screen has at least about 250 holes, has a pitch of at least about 250, and/or has at least about 250 holes per unit of area, such as about 250 holes/cm$^2$. As shown in FIG. 30, in some implementations, the second screen has a larger diameter than the first screen, such as at least about 10% greater. In some variants, the first screen has a larger diameter, more holes in total, a greater pitch, and/or more holes per unit area than the second screen.

In certain embodiments, the foaming unit 198 is located in or adjacent to the nozzle 112. For example, in some embodiments, the foaming unit 198 (e.g., mesh) is positioned at or near the location at which the foamed soap is dispensed from the soap pump 100. In some implementations, the screen is generally vertical, which can aid in reducing drips and/or in separating the foamed soap from the soap pump 100 (e.g., encouraging the foamed soap to fall away from the soap pump 100 by force of gravity). In some implementations, the screen is horizontal.

In some embodiments, the foaming unit 198 is configured to reduce the likelihood of drips. For example, the mesh can be generally planar and positioned at an angle with respect to horizontal, such as less than or equal to about: 3°, 5°, 8°, 10°, 15°, angles between the aforementioned angles, or other angles. In some variants, the angle can encourage, by force of gravity, the foamed soap to slide down and separate from the screen during the dispensation cycle. In some embodiments, the angled mesh can reduce the chance of foamed soap remaining on the mesh (e.g., due to surface tension) after the dispensation cycle ends, which could otherwise subsequently form a drip that falls off of the soap pump 100. In some implementations, the mesh can have a shape with an apex, such as a conical or hemispherical shape. Similar to the discussion above, the apex can encourage foamed soap to separate from the screen during the dispensation cycle and/or can reduce the chance of foamed soap remaining on the mesh after the dispensation cycle ends.

As mentioned above, in some embodiments, the dispensing assembly 110, or other portions of the soap pump 100, include a sensor device 202. In some embodiments, the sensor device 202 can include an infrared type sensor, which can include a light emitting portion and a light receiving portion. The light emitting and light receiving portions can be separate, or can be part of the same device. Some embodiments are configured such that a beam of infrared light can be emitted from the light emitting portion. The light can be reflected off an object and received by the light receiving portion. This reflection can occur as a result of a user's hand or some object being placed near (e.g., in front of, under, or otherwise) the infrared sensor and reflecting back a portion of the emitted infrared light for a predetermined period of time and/or at a predetermined frequency. Further examples and details regarding sensor devices can be found in U.S. Pat. No. 8,087,543, filed Feb. 1, 2007, the entirety of which is hereby incorporated by reference. Any structure, material, component, feature, method, or step described and/or illustrated in the '543 Patent can be used in combination with, or instead of, any structure, material, component, feature, method, or step described and/or illustrated in this specification.

The sensor device 202 can be configured to emit a trigger signal when the infrared light beam is reflected back to the light receiving portion. For example, if the sensor device 202 is activated and the light receiving portion receives the reflected infrared light emitted from the light emitting portion, then the sensor device 202 can emit a trigger signal. The trigger signal can be used for controlling operation of components of the soap pump 100, such as operation of the motor 124.

In some embodiments, the sensor device 202 can be operated in a pulsating mode. For example, the light emitting portion can be powered on and off in a duty cycle, such as for bursts lasting for only a short period of time (e.g., 0.01 second, 0.1 second, 1.0 second, etc.) and/or at a relatively slow frequency (e.g., three times per second, two times per second, one time per second, etc.).

In some embodiments, the sensor device 202 is active for a period of time and inactive for a period of time. For example, in some embodiments, the sensor device 202 is active for a duration of about 50 microseconds at a time and four times per second. Thus, for each second, the sensor device 202 is active for 200 microseconds and inactive for 999,800 microseconds. In certain embodiments, for each one second time period, the sensor device 202 can be active for less than or equal to about: 100 microseconds, 250 microseconds, 500 microseconds, 1,000 microseconds, values between the aforementioned values, or other values. In some implementations, as a percentage of each one second time period, the sensor device 202 is active less than or equal to: 0.05%, 0.5%, 1%, 2%, 3%, percentages between the aforementioned percentages, or other percentages. Such cycling can substantially reduce power consumption. In some implementations, such cycling does not produce unacceptable results because, on the time scale of a user, the sensor device 202 is frequently reactivated (e.g., activated at least once each second). Thus, in certain implementations, the maximum time that a user would need to wait to trigger the sensor device 202 is less than or equal to one second. In some implementations, the sensor device 202 can appear to a user to be continuously activated.

The sensor device 202 can be connected to an ECU (not shown). The ECU can include one or more circuit boards with hard wired feedback control circuits, a processor, and memory devices for storing and performing control routines, or any other type of controller. In some embodiments, the ECU is positioned in the dispensing assembly 110. In some embodiments, the ECU is positioned in the casing 156. In various embodiments, the ECU can control aspects of the soap pump, such as controlling operation of the motor 124, lighting assembly, or otherwise.

As indicated above, the ECU can be connected with a user input device, such as a button, dial, switch, or otherwise. In some embodiments, the ECU can receive an input signal from the user input device to vary the duration and/or amount of soap dispensed for one or more dispensation cycles. For example, the ECU can receive an input from a selector configured to enable a user to select varying degrees of duration and/or amount of soap. In some embodiments, the ECU can receive an input to provide a substantially continuous flow of soap, such as by a user activating the input device in a certain way, such as by pressing a button of greater than or equal to one second.

In some embodiments, the ECU is configured to control the light source described above. For example, the ECU can control the duration, pattern, and/or color of light. In some implementations, the ECU is configured to activate the light source in conjunction with the motor 124, thereby illuminating the light pipe 162 when soap is being dispensed from the soap pump 100. In some embodiments, the dispensing assembly 110 can include the light source and/or one or more emitting portions 204 that are configured to mate with the inlet portions 164 of the light pipe 162, thereby transmitting light into the light pipe 162.

III. Identification Features

In some embodiments, the soap pump 100 is configured to identify a characteristic of the fluid storage unit 102. For example, the fluid storage unit 102 and/or the fluid handling unit 104 can include an identification feature that is configured to provide an indication of a characteristic of the reservoir 120. The characteristic can be the reservoir's contents (e.g., hand soap, dish soap, lotion, etc.), volume, unique identification code, or otherwise.

In some embodiments, the identification feature includes a physical (e.g., mechanical) connection between the fluid storage unit 102 and the fluid handling unit 104. For example, engagement of the fluid storage unit 102 and the fluid handling unit 104 can actuate one or more actuatable members, such as depressible fingers or buttons. In some implementations, the number and arrangement of the actuated actuatable members indicate a characteristic of the reservoir 120. For example, in an embodiment with first and second actuatable members, actuation of the first member can indicate a first characteristic, actuation of the second member can indicate a second characteristic, actuation of the first and second members can indicate a third characteristic.

In some embodiments, the identification feature includes an electrical connection, such as a circuit that is completed when the fluid storage unit 102 and the fluid handling unit 104 are coupled. In certain variants, the identification feature includes a radio frequency transmitter and/or receiver, such as an active or passive radio frequency identification (RFID) tag and corresponding RFID tag reader. For example, the fluid storage unit 102 can include an RFID tag and the fluid handling unit 104 can include an RFID tag reader.

In certain implementations, the identification feature is configured to communicate a signal indicative of the characteristic to the ECU, which can perform the identification of the characteristic. For example, in certain embodiments, the ECU is configured to identify the characteristic by correlating the signal to a stored database of characteristics. In some embodiments, the ECU can implement an action in response to the signal and/or the identification of the characteristic. For example, in some variants, after receiving a signal that the fluid storage and fluid handling units 102, 104 are coupled, the ECU can permit operation of the motor 124. In some embodiments, the ECU is configured to vary the dispensation amount and/or duration in response to an identification of the contents of the reservoir 120, such as a first amount and/or duration when the reservoir 120 contains hand soap and a second amount and/or duration when the reservoir 120 contains dish soap. In some implementations, the ECU is configured to track and/or predict aspects related to the usage of the reservoir 120, such as the remaining volume of soap in the reservoir 120 and/or the number of remaining dispensations of soap in the reservoir 120.

IV. Certain Methods

Figure 31:
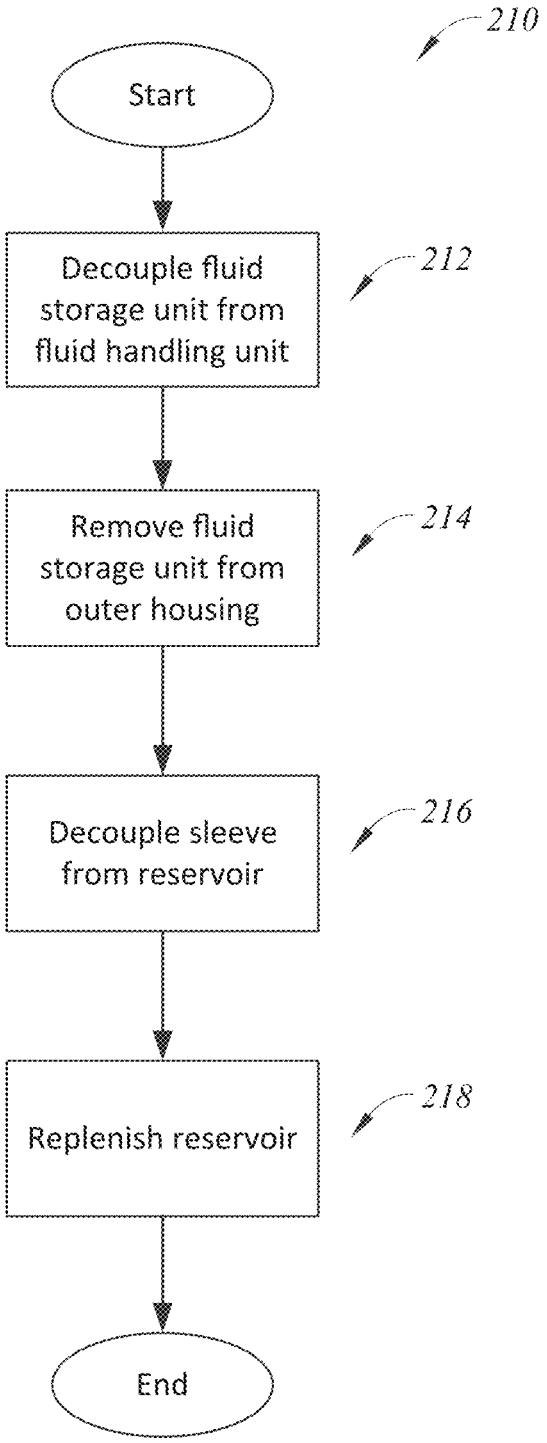
FIG. 31 illustrates a method of replenishing a reservoir.

FIG. 31 illustrates an example method 210 associated with the soap pump 100. As shown, in block 212, the method 210 can include decoupling the fluid storage unit 102 from the fluid handling unit 104. In some embodiments, the decoupling includes activating (e.g., depressing) the coupling actuator 116. This can displace the arm 146 downward relative to the fluid storage unit 102. In some embodiments, such movement of the arm 146 engages the second tooth 150 with a bottom portion of the fluid handling unit 104. This can displace the arm 146 radially outward, which can remove the physical interference between the tooth 148 with the flange 144, thereby removing the coupling between the fluid storage unit 102 and the fluid handling unit 104.

In block 214, the method 210 can include removing the fluid storage unit 102 from outer housing 106. For example, the fluid storage unit 102 can be lifted (e.g., generally vertically) out of the outer housing 106.

In some embodiments, in block 216, the method 210 includes decoupling the sleeve 130 of the fluid storage unit 102 from the reservoir 120 of the fluid storage unit 102. For example, the decoupling can include unscrewing a threaded connection between the sleeve 130 and the reservoir 120.

In block 218, the method can include replenishing the reservoir 120. In some embodiments, such as those in which the reservoir 120 is a reusable item, replenishing the reservoir 120 includes adding liquid soap into the reservoir 120. For example, liquid soap can be added via an opening at or near an upper end of the reservoir 120. In some embodiments, such as those in which the reservoir 120 is a one-time use item, replenishing the reservoir 120 includes replacing the reservoir 120 with another reservoir and/or disposing of the reservoir 120.

In various embodiments, a method of coupling the fluid storage unit 102 from the fluid handling unit 104 includes reversing some or all of the actions described above. For example, the method of coupling the fluid storage unit 102 from the fluid handling unit 104 can include coupling the sleeve 130 of the fluid storage unit 102 with the reservoir 120 of the fluid storage unit 102, such as by securing with a threaded connection between the sleeve 130 and the reservoir 120. Certain embodiments include placing the fluid storage unit 102 within the outer housing 106.

In some implementations, the method of coupling the fluid storage unit 102 and the fluid handling unit 104 includes coupling the fluid storage unit 102 with the fluid handling unit 104. In some variants, this includes activating (e.g., depressing) the coupling actuator 116, which can displace the arm 146. For example, the arm 146 can be moved generally downward and/or against the bias of the biasing member 152. Some implementations include receiving the tooth 148 in the recess 142. Certain embodiments include engaging the tooth 148 with the flange 144. Some variants include providing a physical interference between the tooth 148 with the flange 144, thereby coupling the fluid storage unit 102 and the fluid handling unit 104.

V. Certain Terminology

Terms of orientation used herein, such as "top," "bottom," "horizontal," "vertical," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may permit, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may permit, the term "generally parallel" can refer to something that departs from exactly parallel by less than or equal to 20 degrees.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations.

For example, "a processor configured to carry out recitations A, B, and C" can include a first processor configured to carry out recitation A working in conjunction with a second processor configured to carry out recitations B and C.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

VI. Summary

Although the dispensing devices have been disclosed in the context of certain embodiments and examples, the dispensing devices extend beyond the specifically disclosed embodiments to other alternative embodiments and/or uses of the embodiments and certain modifications and equivalents thereof. Various features and aspects of the disclosed embodiments can be combined with or substituted for one another in order to form varying modes of the conveyor. The scope of this disclosure should not be limited by the particular disclosed embodiments described herein.

Certain features that are described in this disclosure in the context of separate implementations can also be implemented in combination in a single implementation. Conversely, various features that are described in the context of a single implementation can also be implemented in multiple implementations separately or in any suitable subcombination. Although features may be described above as acting in certain combinations, one or more features from a claimed combination can, in some cases, be excised from the combination, and the combination may be claimed as any subcombination or variation of any subcombination.

Moreover, while operations may be depicted in the drawings or described in the specification in a particular order, such operations need not be performed in the particular order shown or in sequential order, and all operations need not be performed, to achieve the desirable results. Other operations that are not depicted or described can be incorporated in the example methods and processes. For example, one or more additional operations can be performed before, after, simultaneously, or between any of the described operations. Further, the operations may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Some embodiments have been described in connection with the accompanying drawings. The figures are drawn to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

In summary, various embodiments and examples of dispensing devices have been disclosed. Although the dispensing devices have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Thus, the scope of this disclosure should not be limited by the particular disclosed embodiments described above, but should be determined only by a fair reading of the claims that follow.

The invention claimed is:

1. A foaming soap pump comprising:

a fluid storage unit comprising a reservoir configured to store a fluid; and a fluid handling unit comprising:

a pumping assembly configured to draw the fluid from the reservoir, the pumping assembly comprising:

a pumping unit comprising a compartment having a resilient member, the resilient member being actuatable between a first state and a second state, a volume of the compartment being greater in the first state than in the second state;

a motor configured to drive an actuation member, the actuation member configured to actuate the resilient member of the pumping unit between the first state and the second state;

wherein, the pumping assembly is configured such that:

when the actuation member actuates the resilient member from the second state to the first state, the volume in the compartment increases, thereby drawing the fluid into the compartment;

when the actuation member actuates the resilient member from the first state to the second state, the volume in the compartment decreases, thereby expelling the fluid from the compartment; and a dispensing assembly configured to receive a flow of the fluid from the pumping assembly, the dispensing assembly comprising:

a foaming unit configured to convert the fluid into a foamed soap product; and a discharge nozzle configured to dispense the foamed soap product out of the foaming soap pump.

2. The foaming soap pump of claim 1, wherein the pumping unit further comprises a plurality of compartments, each with a respective resilient member.

3. The foaming soap pump of claim 2, wherein the plurality of compartments are about equally circumferentially spaced around an outlet conduit of the pumping assembly.

4. The foaming soap pump of claim 1, wherein the resilient member comprises a rubber diaphragm.

5. The foaming soap pump of claim 1, wherein in the first state the resilient member has a convex shape, and in the second state the resilient member has a concave shape.

6. The foaming soap pump of claim 1, wherein the foaming unit comprises a screen in a flow path of the soap.

7. The foaming soap pump of claim 1, wherein the discharge nozzle comprises an anti-drip valve.

8. The foaming soap pump of claim 1, further comprising a lighting assembly comprising a light source and a light pipe.

9. The foaming soap pump of claim 1, wherein the pumping unit further comprises a one-way valve configured to permit soap to enter the compartment through an inlet passage.

10. The foaming soap pump of claim 1, further comprising an air inlet assembly configured to allow ambient air to enter a flow of the liquid soap.

11. The foaming soap pump of claim 1, wherein the fluid storage unit further comprises a sleeve threadably connected with the reservoir.

12. The foaming soap pump of claim 1, further comprising a sensor device configured to detect an object adjacent the dispensing assembly.

13. The foaming soap pump of claim 1, wherein the actuation member comprises an arm extending radially outward from a drive shaft connected with the motor.

14. A method of dispensing foamed soap, the method comprising:

drawing liquid soap from a reservoir;

encouraging the liquid soap into and out of a pumping assembly, wherein encouraging the liquid soap into and out of the pumping assembly comprises:

expanding a portion of a compartment to introduce the liquid soap into the compartment; and contracting a portion of the compartment to expel the liquid soap from the compartment;

mixing the liquid soap with air to form aerated soap;

converting the aerated soap into foamed soap; and dispensing the foamed soap through a nozzle.

15. The method of claim 14, wherein converting the aerated soap into foamed soap comprises passing the aerated soap through a screen.

16. The method of claim 14, wherein converting the aerated soap into foamed soap comprises passing the aerated soap through a first screen and a second screen, wherein the second screen has more holes per unit area than the first screen.

17. The method of claim 14, wherein converting the aerated soap into foamed soap comprises passing the aerated soap through a first screen and a second screen, wherein the first screen has more holes per unit area than the second screen.

18. The method of claim 14, wherein contracting the portion of the compartment comprises engaging a motor-driven tilting member with a resilient member of the compartment.

19. The method of claim 18, wherein expanding the portion of the compartment comprises disengaging the motor-driven tilting member from the resilient member of the compartment.

20. The method of claim 14, wherein encouraging the aerated soap into and out of the pumping assembly further comprises:

expanding a portion of a second compartment to introduce the aerated soap into the second compartment;

contracting a portion of the second compartment to expel the aerated soap from the second compartment;

expanding a portion of a third compartment to introduce the aerated soap into the third compartment; and contracting a portion of the third compartment to expel the aerated soap from the third compartment.

21. The method of claim 20, wherein expanding the portion of the compartment and contracting the portion of the second compartment occur substantially simultaneously.

22. The method of claim 21, wherein expanding the portion of the second compartment and contracting the portion of the third compartment occur substantially simultaneously.

23. The method of claim 22, wherein expanding the portion of the third compartment and contracting the portion of the compartment occur substantially simultaneously.

24. A dispensing device comprising:

a reservoir configured to store a liquid product;

an air inlet;

a pumping assembly configured to draw the liquid product from the reservoir and to draw air through the air inlet, the pumping assembly comprising:

a plurality of compartments; and a plurality of resilient members, each of the resilient members being movable between a first state and a second state, each of the resilient members being associated with one of the compartments, each compartment having a volume that is greater when the associated resilient member is in the first state than in the second state;

a motor configured to drive an actuation member, the actuation member configured to actuate the resilient members between the first state and the second state, thereby drawing the liquid product and air into the pumping assembly and providing a flow of the liquid product and air out of the pumping assembly;

a foaming unit configured to convert the flow of the liquid product and air into a foamed product; and a discharge nozzle configured to dispense the foamed product out of the dispensing device.

25. The dispensing device of claim 24, wherein the foaming unit comprises a screen in the flow path of the aerated product.

26. The dispensing device of claim 24, wherein the product comprises soap.

27. The dispensing device of claim 24, wherein the resilient member comprises a rubber diaphragm.

28. The dispensing device of claim 24, further comprising a lighting assembly comprising a light source and a light pipe.

29. The dispensing device of claim 24, wherein the discharge nozzle comprises an anti-drip valve.

30. The dispensing device of claim 24, wherein each compartment further comprises a one-way valve configured to permit aerated product to enter the compartment through an inlet passage.

* * * * *